US005624766A

United States Patent [19]

Moriguchi et al.

[11] Patent Number: 5,624,766

[45] Date of Patent: Apr. 29, 1997

[54] CEMENTED CARBIDE AND COATED CEMENTED CARBIDE FOR CUTTING TOOL

[75] Inventors: Hideki Moriguchi; Nobuyuki Kitagawa; Toshio Nomura; Mitsunori Kobayashi; Katsuya Uchino; Kazuo Yamagata, all of Itami, Japan

[73] Assignee: Sumitomo Electric Industries, Ltd., Japan

[21] Appl. No.: 397,289

[22] PCT Filed: Apr. 8, 1994

[86] PCT No.: PCT/JP94/00596

§ 371 Date: Mar. 13, 1995

§ 102(e) Date: Mar. 13, 1995

[87] PCT Pub. No.: WO95/05497

PCT Pub. Date: Feb. 23, 1995

[30] Foreign Application Priority Data

Aug. 16, 1993 [JP] Japan ..... 5-222817

[51] Int. Cl.[6] ..... B22F 7/06

[52] U.S. Cl. ..... 428/547; 428/548; 428/552; 407/119

[58] Field of Search ..... 407/119; 428/546, 428/547, 548, 551, 552

[56] References Cited

U.S. PATENT DOCUMENTS

| | | | |
|---|---|---|---|
| Re. 32,111 | 4/1986 | Lambert et al. | 428/212 |
| Re. 34,180 | 2/1993 | Nemeth | 428/547 |
| 4,497,874 | 2/1985 | Hale | 428/551 |
| 4,686,156 | 8/1987 | Baldoni et al. | 428/689 |
| 4,714,660 | 12/1987 | Gates, Jr. | 428/689 |
| 4,720,437 | 1/1988 | Chudo et al. | 428/689 |
| 4,966,627 | 10/1990 | Keshavan et al. | 75/240 |
| 5,116,694 | 5/1992 | Tsukada et al. | 428/689 |
| 5,163,975 | 11/1992 | Martin | 51/293 |
| 5,181,953 | 1/1993 | Nakano et al. | 75/237 |
| 5,188,489 | 2/1993 | Santhanam et al. | 407/119 |
| 5,232,318 | 8/1993 | Santhanam et al. | 407/119 |
| 5,266,389 | 11/1993 | Omori et al. | 428/216 |
| 5,283,030 | 2/1994 | Nakano et al. | 419/53 |
| 5,395,680 | 3/1995 | Santhanam et al. | 428/217 |

FOREIGN PATENT DOCUMENTS

| | | |
|---|---|---|
| 53-114711 | 6/1978 | Japan . |
| B260-5673 | 2/1985 | Japan . |
| B261-42788 | 9/1986 | Japan . |
| 62-170451A | 7/1987 | Japan . |
| A1-287246 | 11/1989 | Japan . |
| 3-97866A | 4/1991 | Japan . |
| 5-255795A | 10/1993 | Japan . |

*Primary Examiner*—Charles T. Jordan
*Assistant Examiner*—Chrisman D. Carroll
*Attorney, Agent, or Firm*—Pennie & Edmonds

[57] ABSTRACT

A coated cemented carbide comprising: a substrate comprising a WC-based cemented carbide containing 4 to 10 wt. % of Co as a binder phase; based on a ratio in a mirror-polished texture of a cross section of the cemented carbide, 70% or more of WC crystals as a hard phase being classified into either of a group of fine particles A having a particle size of from 0.1 to 1 μm and a group of coarse particles B having a particle size of from 3 to 10 μm, the area ratio $S_A/S_B$ of the fine particles A to the coarse particles B being in a range of from 0.22 to 0.45; and a coating layer disposed on a surface of the cemented carbide and having a total thickness in a range of from 5 to 100 μm. The coating layer comprises at least one layer comprising at least one selected from the group consisting of: carbides, nitrides, carbonitrides, oxycarbides, and boronitrides of Ti, Zr, and/or Hf; and at least one layer comprising at least one selected from the group consisting of: $Al_2O_3$ and oxides of Ti, Zr, or Hf.

13 Claims, 8 Drawing Sheets

Fig. 5

TABLE 10

| SAMPLE No. | $S_A/S_B$ | % A+B / WC | TiC wt% | TaC wt% | NbC wt% | Co wt% | Ni wt% | Fe wt% | Cr wt% | V wt% | X-b / a-b |
|---|---|---|---|---|---|---|---|---|---|---|---|
| 19* | 0.14 | 95 | | | | 6 | 0.1 | | | | 0.7 |
| 20* | 1.0 | 88 | | | | 6.5 | | 10 | 3 | | 0.6 |
| 21* | 0.45 | 70 | 3 | 2 | | 6.5 | 10 | | | 3 | 0.75 |
| 22 | 0.34 | 79 | | | | 4 | 0.1 | | | | 0.15 |
| 23 | 0.22 | 88 | | | | 10 | 10 | | 3 | | 0.7 |
| 24 | 0.45 | 87 | | | | 10 | | 0.1 | | 3 | 0.75 |
| 25 | 0.34 | 90 | | | | 4 | | 10 | 0.1 | | 0.75 |
| 26 | 0.33 | 80 | 3 | 1 | | 6 | 2 | 2 | | | 0.8 |
| 27 | 0.45 | 80 | 2 | 2 | 1 | 10 | 2 | | | 0.1 | 0.8 |
| 28 | 0.22 | 81 | 5 | | | 4 | | 10 | | 0.1 | 0.72 |
| 29 | 0.45 | 87 | | | 5 | 7 | 0.1 | | | 3 | 0.75 |
| 30 | 0.39 | 87 | | 4 | 1 | 2 | 10 | | 0.1 | | 0.8 |
| 31 | 0.40 | 92 | | 5 | | 6 | | 0.1 | 3 | | 0.9 |
| 32 | 0.40 | 87 | | 5 | | 6 | | 0.1 | 3 | | 0.67 |
| 33 | 0.40 | 87 | | 5 | | 6 | | 0.1 | 3 | | 0.33 |
| 34 | 0.40 | 87 | | 5 | | 6 | | 0.1 | 3 | | 0 |
| 35 | 0.40 | 87 | | 5 | | 6 | | 0.1 | 3 | | -0.5 |

Fig. 6

TABLE 11 CUTTING CONDITIONS 1

| SAMPLE No. | A* | B* | E | F | G | H | I | J |
|---|---|---|---|---|---|---|---|---|
| 19* | 4.1 | 0.9 | 2.8 | 2.2 | 1.5 | 1.5 | 3.0 | 0.4 |
| 20* | 1.5 | 0.8 | 2.1 | 0.5 | 0.2 | 0.1 | 1.5 | 0.2 |
| 21* | 2.0 | 1.6 | 2.0 | 2.5 | 4.0 | 3.0 | 2.5 | 2.3 |
| 22 | 6.0 | 3.2 | 10.0 | 12.0 | 16.0 | 11.0 | 10.1 | 19.0 |
| 23 | 4.0 | 1.9 | 8.5 | 10.3 | 14.5 | 10.9 | 8.9 | 18.3 |
| 24 | 4.1 | 2.3 | 8.8 | 9.5 | 11.3 | 8.1 | 7.6 | 12.9 |
| 25 | 5.0 | 2.5 | 10.2 | 14.0 | 16.2 | 8.5 | 8.0 | 21.0 |
| 26 | 7.0 | 3.5 | 15.0 | 20.3 | 21.1 | 10.6 | 9.5 | 24.3 |
| 27 | 5.0 | 2.7 | 12.0 | 13.5 | 15.1 | 11.0 | 10.0 | 30.1 |
| 28 | 4.4 | 3.0 | 10.1 | 14.0 | 16.0 | 10.3 | 7.7 | 32.1 |
| 29 | 5.0 | 2.5 | 13.0 | 15.3 | 18.1 | 11.2 | 8.5 | 33.0 |
| 30 | 4.0 | 1.0 | 10.5 | 14.2 | 16.0 | 12.0 | 11.0 | 31.5 |
| 31 | 5.0 | 2.3 | 11.0 | 16.0 | 18.1 | 11.5 | 10.3 | 32.0 |
| 32 | 6.0 | 3.3 | 13.0 | 17.9 | 19.9 | 12.0 | 10.5 | 30.9 |
| 33 | 6.5 | 3.4 | 14.0 | 19.0 | 20.5 | 13.0 | 10.3 | 40.5 |
| 34 | 6.7 | 3.6 | 15.0 | 19.5 | 21.0 | 13.2 | 12.1 | 40.6 |
| 35 | 6.7 | 3.6 | 16.0 | 19.3 | 21.3 | 13.4 | 11.1 | 40.7 |

SAMPLES SURROUNDED BY A BOX ARE THOSE ACCORDING TO THE PRESENT INVENTION

Fig. 7

TABLE 12 CUTTING CONDITIONS 2

| SAMPLE No. | A* | B* | E | F | G | H | I | J |
|---|---|---|---|---|---|---|---|---|
| 19* | 0.1 | 0.2 | 1.9 | 1.0 | 0.6 | 1.2 | 2.1 | 0.6 |
| 20* | 0.5 | 0.5 | 1.8 | 1.0 | 0.6 | 1.0 | 2.0 | 1.2 |
| 21* | 0.5 | 1.0 | 2.0 | 2.1 | 2.8 | 3.0 | 3.9 | 1.2 |
| 22 | 0.1 | 1.8 | 7.0 | 7.0 | 6.8 | 9.0 | 15.8 | 13.0 |
| 23 | 0.3 | 1.4 | 8.5 | 8.3 | 7.9 | 9.9 | 18.0 | 12.9 |
| 24 | 0.2 | 1.3 | 8.3 | 8.0 | 7.0 | 10.3 | 19.0 | 17.5 |
| 25 | 0.1 | 1.5 | 9.5 | 9.0 | 8.5 | 14.0 | 22.0 | 20.3 |
| 26 | 0.2 | 1.3 | 10.5 | 10.0 | 9.5 | 12.0 | 25.0 | 22.5 |
| 27 | 0.3 | 1.0 | 13.0 | 11.5 | 10.5 | 19.0 | 33.0 | 31.0 |
| 28 | 0.1 | 1.2 | 9.4 | 9.0 | 8.8 | 11.0 | 20.5 | 18.9 |
| 29 | 0.1 | 1.0 | 12.0 | 11.0 | 10.3 | 15.0 | 30.0 | 19.8 |
| 30 | 0.2 | 0.5 | 10.3 | 9.8 | 9.5 | 13.0 | 24.0 | 22.0 |
| 31 | 0.5 | 1.1 | 14.0 | 13.5 | 12.9 | 14.9 | 25.3 | 21.0 |
| 32 | 0.7 | 1.3 | 16.0 | 15.0 | 14.3 | 15.3 | 28.0 | 20.3 |
| 33 | 0.9 | 1.6 | 18.0 | 17.0 | 17.0 | 16.8 | 30.1 | 19.0 |
| 34 | 1.0 | 1.8 | 20.5 | 19.0 | 18.8 | 17.7 | 32.0 | 24.0 |
| 35 | 1.0 | 1.7 | 21.0 | 20.0 | 18.9 | 19.0 | 32.1 | 28.0 |

SAMPLES SURROUNDED BY A BOX ARE THOSE ACCORDING TO THE PRESENT INVENTION

Fig. 8

TABLE 13

| SAMPLE No. | $S_A/S_B$ | % A+B/WC | TiCN wt% | HfCN wt% | TiN wt% | HfN wt% | Co wt% | Ni wt% | Fe wt% | Cr wt% | C μm | X-b/a-b |
|---|---|---|---|---|---|---|---|---|---|---|---|---|
| 36 * | 0 | 75 | 12.0 | 3.0 | | | 7 | 2 | | | 10 | 0.7 |
| 37 | 0.40 | 80 | 10.0 | 5.0 | | | 7 | 2 | 0.5 | | 0 | 0.7 |
| 38 | 0.40 | 80 | 12.0 | | | 3.0 | 7 | 2 | | | 5 | 0 |
| 39 | 0.40 | 80 | | | 12.0 | 3.0 | 7 | 2 | | 3 | 50 | 0.67 |

| SAMPLE No. | $S_A/S_B$ | A+B/WC | TiCN wt% | ZrCN wt% | TaCN wt% | NbCN wt% | ZrN wt% | TaN wt% | NbN wt% | Co wt% | Ni wt% | Fe wt% | Cr wt% | V wt% | C μm | X-b/a-b |
|---|---|---|---|---|---|---|---|---|---|---|---|---|---|---|---|---|
| 40 | 0.40 | 80 | | 3.0 | 5.0 | 2.0 | 2.0 | | | 10 | | 0.2 | | | 50 | 0 |
| 41 | 0.40 | 80 | | 5.0 | 10.0 | | | | | 10 | | | 0.5 | | 5 | 0.5 |
| 42 | 0.40 | 80 | 1.5 | | | | | 9.0 | 4.5 | 10 | | | | 3 | 0 | -0.5 |
| 43 | 0.40 | 80 | | | | | 4.0 | 6.0 | | 10 | 2 | | | | 25 | 0.3 |
| 44 | 0.40 | 80 | 1.0 | 4.0 | | | | | | 8 | 2 | | | | 5 | 0.67 |
| 45 | 0.40 | 80 | | | | | 4.0 | | | 8 | 2 | | | | 20 | 0.67 |

Fig. 9

TABLE 14 CUTTING CONDITION 3

| SAMPLE No. | A* | B* | E | F | G | H | I | J |
|---|---|---|---|---|---|---|---|---|
| 36* | 1.0 | 1.3 | 1.1 | 2.1 | 2.5 | 0.9 | 2.9 | 3.1 |
| 37 | 4.5 | 3.8 | 14.0 | 16.0 | 15.6 | 13.5 | 12.1 | 15.9 |
| 38 | 3.8 | 2.9 | 12.0 | 14.3 | 14.7 | 12.3 | 10.5 | 16.8 |
| 39 | 2.9 | 3.0 | 11.5 | 13.2 | 13.9 | 12.2 | 10.2 | 12.9 |
| 40 | 6.0 | 4.8 | 16.0 | 16.6 | 16.9 | 15.5 | 14.9 | 20.9 |
| 41 | 6.8 | 5.5 | 18.3 | 17.7 | 16.9 | 16.8 | 16.9 | 22.8 |
| 42 | 7.9 | 7.0 | 25.0 | 22.9 | 22.3 | 22.0 | 17.3 | 29.5 |
| 43 | 8.5 | 7.1 | 21.0 | 20.1 | 19.9 | 18.8 | 16.2 | 24.5 |
| 44 | 8.3 | 7.5 | 25.0 | 22.3 | 28.0 | 24.1 | 22.0 | 23.9 |
| 45 | 9.5 | 8.2 | 23.3 | 24.6 | 26.2 | 22.9 | 19.1 | 22.9 |

SAMPLES SURROUNDED BY A BOX ARE THOSE ACCORDING TO THE PRESENT INVENTION

Fig. 10

TABLE 15 CUTTING CONDITION 4

| No. | A* | B* | E | F | G | H | I | J |
|---|---|---|---|---|---|---|---|---|
| 36 | 0.1 | 0.5 | 0.2 | 0.1 | 0.1 | 0.1 | 0.4 | 0.1 |
| 37 | 2.5 | 3.0 | 8.5 | 9.0 | 11.0 | 19.0 | 22.0 | 20.5 |
| 38 | 2.9 | 5.0 | 11.0 | 10.9 | 12.3 | 20.3 | 23.4 | 23.3 |
| 39 | 3.8 | 6.8 | 13.9 | 12.9 | 13.5 | 22.9 | 26.0 | 24.1 |
| 40 | 7.5 | 9.5 | 20.9 | 21.9 | 29.0 | 39.0 | 39.9 | 38.5 |
| 41 | 5.5 | 8.5 | 19.9 | 18.6 | 22.6 | 37.5 | 38.4 | 40.2 |
| 42 | 4.5 | 7.9 | 15.8 | 14.4 | 19.3 | 22.5 | 24.5 | 28.0 |
| 43 | 5.9 | 9.0 | 25.0 | 24.3 | 30.0 | 45.5 | 51.3 | 50.3 |
| 44 | 5.5 | 6.2 | 26.5 | 26.3 | 32.5 | 42.5 | 50.0 | 51.3 |
| 45 | 8.9 | 8.9 | 29.9 | 28.8 | 38.8 | 49.9 | 59.9 | 60.3 |

SAMPLES SURROUNDED BY A BOX ARE THOSE ACCORDING TO THE PRESENT INVENTION

CEMENTED CARBIDE AND COATED CEMENTED CARBIDE FOR CUTTING TOOL

TECHNICAL FIELD

The present invention relates to a coated cemented carbide, and more particularly to a coated cemented carbide which may suitably be used for tools such as cutting tools, wear-resistant tools, impact-resistant tools, and mining tools (particularly, cutting tools suitable for the cutting of general steel, a material having poor machinability or cuttability (hard-to-machine material), etc.).

BACKGROUND ART

Heretofore, as materials for cutting tools for cutting general steel, there has been used P-type cemented carbide according to the JIS (Japanese Industrial Standard) classification, such as alloy comprising a WC-Co alloy and 10 wt % or more of a carbide/nitride of Ti, Ta or Nb added thereto. Recently, along with an increase in cutting speed in cutting conditions, there has been increased the proportion of a coated cemented carbide to be used for the cutting tool material. Typically, such a coated cemented carbide comprises a substrate material of an M-type cemented carbide (e.g., an alloy comprising a WC-Co cemented carbide containing 5–10 wt % of a carbide/nitride of Ti, Ta or Nb added thereto), the surface of which has been coated with an about 3–10 μm-thick ceramic layer (coating) comprising TiC, TiCN, TiN, $Al_2O_3$, etc., by using a vapor-phase deposition process such as chemical vapor deposition (CVD) and physical vapor deposition (PVD).

However, in some cases, when the cemented carbide is covered with the above-mentioned coating, there has been posed a problem such that the coating layer itself comprising a brittle material is liable to provide a defect, or an η phase (a general term for a decarburization phase comprising of $Co_3W_3C$, etc.) is produced at the surface of the substrate material of cemented carbide, thereby to reduce the coating strength. In order to prevent the occurrence of such a defect and/or η phase, various attempts have been made to improve the cemented carbide as a substrate material to be coated.

For example, Japanese Patent Publication (KOKOKU) No. 7349/1984 (i.e., Sho 59-7349) discloses a substrate material for coated cemented carbide which has been caused to contain free carbon so as to suppress the occurrence of the η phase, which is liable to appear at the surface of the cemented carbide substrate at the time of the coating. Further, Japanese Laid-Open Patent Application (KOKAI) No. 97866/1991 (i.e., Hei 3-97866) proposes a tool of coated cemented carbide comprising a substrate material of a cemented carbide having a low carbon content which has been coated by a CVD process using a reactant gas capable of hardly forming the η phase as a starting material. Furthermore, Hisashi Suzuki, "Cemented carbides and Sintered Hard Materials" page 221, (1986) published by Maruzen K.K. (Tokyo, JAPAN) discloses a technique for preventing a decrease in the strength at the time of coating such that a β phase-reduced layer (a phase or layer in which a composite carbide/nitride phase such as (W, Ti) (C, N) has disappeared) is formed on the surface of a substrate material for coated cemented carbide so as to increase the Co content in a surface region of the cemented carbide.

The formation of the η phase can be prevented by utilizing the above-mentioned techniques disclosed in Japanese Patent Publication No. 7349/1984 and Japanese Laid-Open Patent Application No. 97866/1991. However, the thickness of the η phase which has been prevented from being formed is as small as about 5 μm, and therefore the effect thereof is not enough to prevent the propagation of a fatigue crack of 100 μm or more which actually poses a problem in practical use of a cutting tool (Atsushi Fukawa, "Powder and Powder Metallurgy" 41 (1), page 3 (1994)). As a result, the actual service life of the resultant cutting tool is still short.

According to the above-mentioned technique for forming the β phase-reduced layer in a cemented carbide substrate material, a region in which the binder phase content has been increased, can be formed in a thickness of about 20 μm at the surface of the cemented carbide, so that the prevention of the initial breakage thereof can be expected. However, since the thickness of such a region is small in comparison with the length of the fatigue crack, the effect of suppressing the propagation of the crack is little. In addition, since the binder phase content at the surface of the cemented carbide is increased, the service life of the tool is rather shortened under a high-speed cutting condition, on the basis of a decrease in the resistance thereof to plastic deformation.

In general, the strength of cemented carbides having the same Co content substantially has a certain correlation with the WC particle size in the cemented carbide. As the WC particle size becomes smaller, the bending strength of the cemented carbide is increased, but the fracture toughness thereof is decreased. On the other hand, it is considered that when the bending strength is increased, a fine crack is less liable to occur, and that when the fracture toughness is increased, the propagation of a fine crack is retarded to a larger extent. Accordingly, in order to increase the service life of a tool, it is necessary to improve both of the strength and the toughness. From such a viewpoint, considerable efforts have been made to make such improvement.

As a cemented carbide having both of strength and toughness which has been improved by such developing efforts, for example, Japanese Laid-Open Patent Application No. 170451/1987 (i.e., Sho 62-170451) and U.S. Pat. No. 4,966,627 propose cemented carbides in which the hard phase such as WC comprises fine particles and coarse particles. However, these cemented carbides are not ones which have been developed while taking sufficient consideration of usage thereof as a substrate material for coated cemented carbide for cutting general steel, so that the optimization was insufficient in view of a cemented carbide substrate material, the surface of which is to be coated. As a result, in a case where these cemented carbide substrate materials are used for constituting a coated cutting tool, the performance of the resultant tool is still insufficient.

Further, Japanese Laid-Open Patent Application No. 255795/1993 (Hei 5-255795) describes a coated cutting tool in which WC as a hard phase constituting the cemented carbide substrate material is classified into three kinds, i.e., coarse particles, medium particles and fine particles, and the contents of these three species of particles are defined. In this coated cutting tool, an effect of suppressing the propagation of a crack is intended by defining the particle size distribution in WC in the above-described manner. However, since the particle size distribution is simply wider than that in the conventional product but is continuous, it is not expected that the resistance thereof to plastic deformation as a coated cutting tool is improved by reducing the binder phase content. In addition, in the cutting tool disclosed in the above Japanese Laid-Open Patent Application No. 255795/1993, since the WC fine particle content is high, the effect of suppressing the propagation of a crack is insufficient.

More specifically, in recent years, the cutting condition under which a coated cemented carbide is to be used becomes severer to a considerable extent. For example, in the case of high-speed cutting at a cutting speed of 300 m/min. or higher, the temperature at the tip of the cutting edge becomes extremely high. Accordingly, an improvement in the resistance to plastic deformation under such a high temperature is particularly demanded. In addition, in order to suppress the propagation of wear of a cutting tool, the cutting tool is often subjected to wet cutting wherein a coolant is used in combination therewith. Such wet cutting is particularly liable to cause breakage of the cutting tool. Accordingly, there has been strongly desired a coated cemented carbide capable of providing a tool which not only has an improved resistance to plastic deformation at a high temperature, but also is less liable to be broken under wet cutting.

An object of the present invention is to provide a coated cemented carbide which has solved the above-mentioned problems encountered in the prior art.

Another object of the present invention is to provide a coated cemented carbide which has been improved in strength and toughness while providing an appropriate balance therebetween.

A further object of the present invention is to provide a coated cemented carbide which has been improved in resistance to plastic deformation at a high temperature and is suitably applicable to a tool which is hardly broken during wet cutting.

A yet further object of the present invention is to provide a coated cemented carbide which is suitably applicable to a cutting tool which can exhibit good cutting performance in the cutting of general steel and a hard-to-machine material at a high speed and is capable of providing a longer service life of a tool.

DISCLOSURE OF INVENTION

The coated hard metal of the present invention comprises:

a substrate comprising a WC-based hard metal containing 4 to 10 wt. % of Co as a binder phase; based on a ratio in a mirror-polished texture of a cross section of the hard metal, 70% or more of WC crystals as a hard phase being classified into either of a group of fine particles A having a particle size of from 0.1 to 1 μm and a group of coarse particles B having a particle size of from 3 to 10 μm, the area ratio $S_A/S_B$ of the fine particles A to the coarse particles B being in a range of from 0.22 to 0.45; and a coating layer disposed on a surface of the hard metal and having a total thickness in a range of from 5 to 100 μm; the coating layer comprising at least one layer comprising at least one selected from the group consisting of: carbides, nitrides, carbonitrides, oxycarbides, and boronitrides of Ti, Zr, and/or Hf; and at least one layer comprising at least one selected from the group consisting of: $Al_2O_3$ and oxides of Ti, Zr, or Hf.

The present invention further provides a coated hard metal, comprising: a substrate comprising a WC-based hard metal containing 4 to 10 wt. % of Co as a binder phase; and a coating layer disposed on a surface of the hard metal and having a total thickness in a range of from 0.2 to 10 μm;

(a) based on a ratio in a mirror-polished texture of a cross section of the hard metal, 70% or more of WC crystals as a hard phase being classified into either of a group of fine particles A having a particle size of from 0.1 to 1 μm and a group of coarse particles B having a particle size of from 3 to 10 μm, the area ratio $S_A/S_B$ of the fine particles A to the coarse particles B being in a range of from 0.22 to 0.45;

(b) the carbon content X (wt. %) in the hard metal substrate satisfies a relationship of:

$$-0.5 \leqq (X-b)/(a-b) \leqq 0.67,$$

wherein a(wt. %) denotes the lower limit of carbon content at which free carbon is formed in the hard metal having the corresponding composition, and b (wt. %) denotes the upper limit of carbon content at which an η phase is formed in the hard metal having the corresponding composition; and (c) the coating layer comprising at least one layer (a single layer or a plurality of layers) comprising a carbide, nitride, or carbide/nitride of Ti, or a carbide, nitride, or carbide/nitride of an alloy of Ti and Al.

The above-described coated hard metal according to the present invention has been provided on the basis of the results of study conducted by the present inventors as described below.

As a result of earnest study of a mechanism of wear of tools during a process for cutting general steel and hard-to-machine materials, the present inventors have discovered that when steel is cut at a high cutting speed of not less than 300 m/min. or a Ni-based, heat-resistant alloy is cut at a high cutting speed of not less than 100 m/min., the temperature at the tip of the cutting tool edge reaches 1000 ° C. or higher; when a cutting tool is subjected to wet cutting so as to suppress the propagation of wear of the tool, the cutting tool is alternately and repetitively subjected to a high temperature at the time of cutting (such as intermittent cutting, milling, and cutting of a large number of workpieces) and to cooling at the time other than the cutting, and great thermal shock is imparted to the tool because of such cutting, and therefore a crack or cracks are introduced into the tool thereby to cause peeling and/or breakage of the coating layer of the tool; and further the crack or cracks are fatiguingly propagated due to the above-mentioned repetitive shock to finally invite the breakage of the tool, and thus the service life of the tool is ended in a short period of time.

As described hereinabove, from the viewpoint of preventing a decrease in the strength of a coated hard metal, various improvements have been effected on the hard metal as a substrate material to be coated, for the purpose of preventing the formation of a defect in the coating layer itself, and the formation of an η phase at the surface of the hard metal substrate material. For example, the above-described Japanese Patent Publication No. 7349/1984, Japanese Laid-Open Patent Application No. 97866/1991, and Hisashi Suzuki, "Hard Metals and Sintered Hard Materials" page 221, disclose a technique for preventing the η phase which is liable to be formed at the surface of the substrate material for a coated hard metal, or for imparting high toughness or tenacity to the surface of a hard metal substrate material. However, these techniques have merely improved the very thin region near the surface of the hard metal substrate material, and therefore, it is impossible to stop the propagation of the fatigue crack extending to a length of 100 μm or larger to prolong the service life of the cutting tool.

On the basis of study on the above experiments and facts, the present inventors have found that both of the strength and toughness of a hard metal may be improved by utilizing a WC-based hard metal comprising a mixture of WC crystals (instead of WC crystals having a single particle size) comprising fine particle having a predetermined particle size and coarse particles having a predetermined particle size, and further causing the ratio ($S_A/S_B$) between such fine particles A and coarse particles B to have a predetermined value. As a result of further study, the present inventors have also found that when the above-described hard metal is used as a substrate material and is coated with a predetermined material to provide a coated hard metal, the above-mentioned propagation of a fatigue crack may be suppressed and excellent cutting performance may be obtained even in combination with general steel or hard-to-machine materials, and completed the present invention.

BRIEF DESCRIPTION OF DRAWINGS

FIG. 5 (Table 10) is a table showing an area ratio of fine particles A to coarse particles B, and a composition in each of the cemented carbide samples obtained in Example 4 appearing hereinafter.

FIG. 6 (Table 11) is a table showing cutting service life of each of combinations of cemented carbide substrate materials and coating layers obtained in Example 4 appearing hereinafter, when they are subjected to performance evaluation under Cutting Conditions (1) to be described below.

FIG. 7 (Table 12) is a table showing cutting service life of each of combinations of cemented carbide substrate materials and coating layers obtained in Example 4 appearing hereinafter, when they are subjected to performance evaluation under Cutting Conditions (2) to be described below.

FIG. 8 (Table 13) is a table showing an area ratio of fine particles A to coarse particles B, and a composition in each of the cemented carbide samples obtained in Example 5 appearing hereinafter.

FIG. 9 (Table 14) is a table showing cutting service life of each of combinations of cemented carbide substrate materials and coating layers obtained in Example 5 appearing hereinafter, when they are subjected to performance evaluation under Cutting Conditions (3) to be described below.

FIG. 10 (Table 15) is a table showing cutting service life of each of combinations of cemented carbide substrate materials and coating layers obtained in Example 5 appearing hereinafter, when they are subjected to performance evaluation under Cutting Conditions (4) to be described below.

BEST MODE FOR CARRYING OUT THE INVENTION

Figure 1:
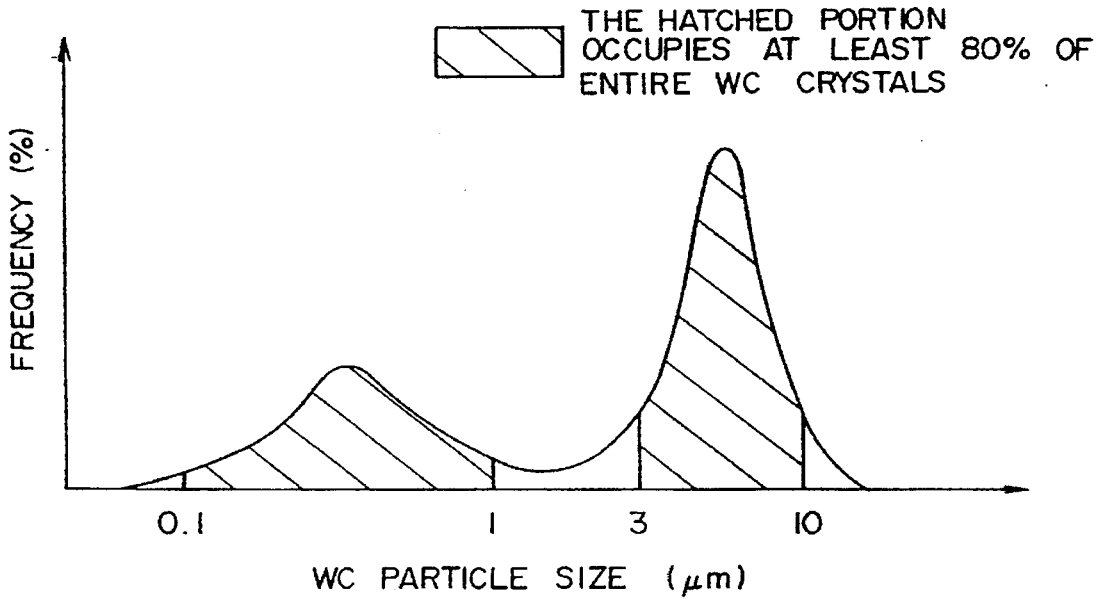
FIG. 1 is a graph schematically showing an example of a relationship between WC particle sizes and frequencies of the WC particles having a corresponding particle size in a substrate material for a coated cemented carbide according to the present invention.

The present invention will be described in more detail with reference to the drawings, as desired.

The coated cemented carbide according to the present invention comprises a WC (tungsten carbide)-based cemented carbide as a substrate material, and a coating layer comprising a predetermined material which is disposed on a surface of the substrate material.

(WC-based cemented carbide)

The WC-based cemented carbide to be used in the present invention comprises, at least, 4–10 wt. % of Co as a binder phase and WC as a hard phase.

(Hard phase)

In WC crystals as a hard phase constituting the substrate material for coated cemented carbide according to the present invention, not less than 70 area % (preferably, not less than 80 area %) of the entire WC crystals are classified into either one of a group of fine particles A having a particle size of from 0.1 to 1 μm and a group of coarse particles B having a particle size of from 3 to 10 μm (more preferably from 3 to 6 μm). In the present invention, when the average particle size of the fine particles A is denoted by $P_A$ and the average particle size of the coarse particles B is denoted by $P_b$, the ratio $P_B/P_A$ may preferably be 3 or more, more preferably 5 or more (particularly preferably, 7 or more).

These average particle sizes $P_A$ and $P_B$ may be determined, e.g., in the following manner. Thus, an arbitrary cross section of an alloy to be evaluated is mirror-polished and five fields of the cross section are photographed at a magnification of not less than 1500x (1500 power). From the thus obtained five photographs, the average particle size ($P_A$) of the fine particles A and the average particle size ($P_B$) of the coarse particles B may be determined by means of an image processing apparatus.

In the present invention, the particle sizes of the entire WC crystals may fall into either of the above-mentioned two kinds of particle sizes (i.e., 0.1–1 μm and 3–10 μm). However, in view of easiness in the preparation of the cemented carbide to be used for such a purpose, it is sufficient that not less than 70 area % (more preferably, not less than 80 area %) of the entire WC crystals are classified into either of the above groups of fine particles A and coarse particles B.

The above fine particles A mainly have a function of increasing the strength and hardness of the substrate material for coated cemented carbide, and the coarse particles B mainly have a function of preventing the propagation of a fatigue crack.

As the prior art, Japanese Laid-Open Patent Application No. 170451/1987 as described above discloses a cemented carbide having a weight ratio A/B of fine particles A to coarse particles B of from 0.33 to 3 (corresponding to an ratio of from 0.48 to 2.08, when converted into an area ratio). However, according to the present inventors' investigation, it has been found that in a case where the ratio of the fine particles to the coarse particles fall within such a range, the effect of suppressing the propagation of a fatigue crack is insufficient when used as a coated cutting tool.

Further, the above-described Japanese Laid-Open Patent Application No. 255795/1993 proposes a coated cemented carbide in which WC particles are classified into coarse particles, medium particles and fine particles, and contents thereof are defined. However, according to the present inventors' investigation, it has been found that since the particle size distribution of the WC particles is continuous in this cemented carbide, and therefore the coarse and fine WC particles cannot fully exhibit their predominant features.

In contrast thereto, since the present invention defines the area ratio $S_A/S_B$ of the fine particles A to the coarse particles B in the range of from 0.22 to 0.45, based on an area ratio in a mirror-polished texture of an arbitrary cross section of a cemented carbide, there may be provided a coated cemented carbide which has been improved in strength and toughness in a good balance therebetween without losing the predominant features peculiar to the above-mentioned respective kinds of particles A and B. Particularly, when such a coated cemented carbide according to the present invention is used for a tool such as cutting tool, the propagation of a fatigue crack is especially suppressed while well maintaining the bending strength and hardness thereof. As a result, the coated cemented carbide is caused to exhibit excellent cutting performance in the cutting of general steel and a hard-to-machine material.

If the area ratio $S_A/S_B$ of the fine particles A to the coarse particles B, based on the ratio in a mirror-polished texture of an arbitrary cross section of the cemented carbide, is less than 0.22, the strength is insufficient as the cemented carbide since the fine particle A content is too small. On the other hand, if the ratio $S_A/S_B$ exceeds 0.45, the fracture toughness of the cemented carbide is decreased and the effect of suppressing the propagation of a fatigue crack is weakened.

In the particle size distribution of the WC crystals constituting the cemented carbide according to the present invention, it is preferred that there are at least two peaks (at least one peak in the fine particle A range, and at least one peak in the coarse particle B range), as shown in FIG. 1. Further, as described above, the ratio $P_B/P_A$ of the average particle sizes of two kinds of the particles may preferably be at least 3 (more preferably at least 5, and particularly preferably at least 7).

(Area ratio)

As described above, in the present invention, the content ratio of fine WC particles (fine particles A) to coarse WC particles (coarse particles B) in the substrate material for coated cemented carbide is defined in terms of an area ratio $S_A/S_B$ in a mirror-polished texture of an arbitrary cross section of the cemented carbide. Such an area ratio $S_A/S_B$ may preferably be determined, e.g., by the following method.

Thus, an arbitrary cross section of the cemented carbide is mirror-polished and then subjected to etching, e.g., by use of an aqueous solution of NaOH-red prussiate of potash ($K_3[Fe(CN)_6]$), which is called as "Murakami's reagent". Then, five fields (five photographs) are taken at a magnification of at least 1500x with an optical microscope or a scanning electron microscope. (In the photograph thus obtained, since the WC particles are polygonal as shown in the schematic view of FIG. 2, the WC particles may be distinguished from the binder phase or other carbides on the basis of their color tones.) The photographs thus obtained (all of five fields) are subjected to binarizing processing (converted into binary data) by means of an image processing apparatus (trade name: LA555, manufactured by Pias Kabushiki Kaisha) so that the WC particles are selectively imparted with a black color and other portions are imparted with a white color. Then, the resultant data are subjected to particle dispersion processing (particle separation processing) so as to remove the effect of overlapping of the respective particles. Thereafter, the respective particles are classified into predetermined two species of groups, i.e., fine particles A and coarse particles B, thereby to determine the total area of the fine particles A ($S_A$), the total area of the coarse particles B ($S_B$), and an area ratio $S_A/S_B$ of the fine particles A to the coarse particles B.

With respect to the particle size (or particle diameter) as the standard of the above classification, the maximum of the lengths of diagonal lines in the case of polygonal WC particles, or the maximum of the lengths of the sides in the case of triangular WC particles, is treated as the value of the particle size, and particles having a particle sizes of from 0.1 to 1 μm are classified as the fine particles A, and particles having a particle sizes of from 3 to 10 μm are classified as the coarse particles B.

When the WC particles constituting the cemented carbide are hypothetically spherical, the particle size of the fine particles A is denoted by $r_A$ and the particle size of the coarse particles B is denoted by $r_B$, the area is represented by $\pi(r/2)^2$ and the volume is represented by $4\pi(r/2)^3/3$. Accordingly, the area ratio X of the fine particles A to the coarse particles B is represented by $(r_A/r_B)^2$. Further, the volume ratio Y of the fine particles A to the coarse particles B is represented by $(r_A/r_B)^3$. Since the densities of smaller spheres and larger spheres are the same, the above-mentioned volume ratio Y is also equal to the weight ratio of the fine particles A to the coarse particles B. Accordingly, in such a case, a relationship of $Y=X^{3/2}$ is provided, and therefore an area ratio X of 0.22 corresponds to a weight ratio Y of 0.1, and an area ratio X of 0.45 corresponds to a weight ratio Y of 0.3.

(Substrate material for coated cemented carbide) As described above, the substrate material for coated cemented carbide according to the present invention is excellent in both of strength and toughness, on the basis of an optimum combination of the fine particles A and the coarse particles B constituting the WC crystals. Accordingly, when such a substrate material is coated with an appropriate ceramic layer or film in accordance with its usage, the substrate material according to the present invention may function as an optimum material for a tool for cutting hard-to-machine materials as well as general steel.

Figure 2:
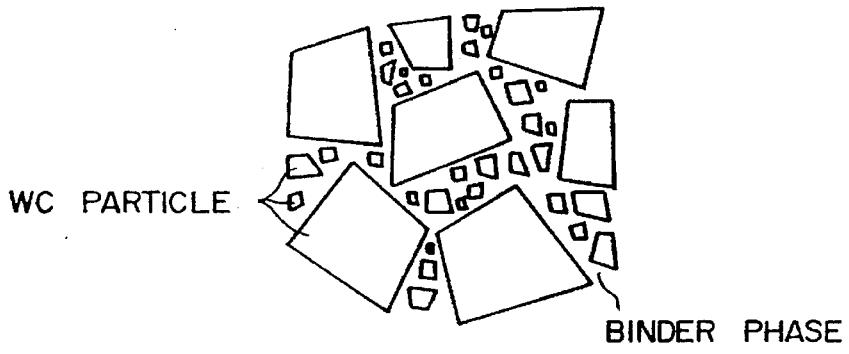
FIG. 2 is a schematic cross sectional view showing an example of a relationship among WC coarse particles, WC fine particles, and a binder phase in the coated cemented carbide according to the present invention.

On the basis of the combination of the fine particles and coarse particles having the predetermined particle sizes, the cemented carbide according to the present invention has a structure such that the fine WC particles enter into spaces among the coarse WC particles so that the spaces among the coarse WC particles are filled with the fine WC particles, as shown in FIG. 2. Accordingly, a cemented carbide may be formed even by use of a small amount of a binder phase, thereby to provide an excellent resistance to plastic deformation. In addition, according to the present inventors' investigation, in a case where the same amount of the binder phase is used, it is presumed that the mechanical property is improved on the basis of an increase in mean free path of the binder phase in the entire cemented carbide.

(Binder phase)

In the substrate material for coated cemented carbide according to the present invention, the toughness as the cemented carbide may be improved on the basis of the above-described optimum combination of the fine particles and coarse particles of WC crystals, even when the amount of Co constituting the binder phase is not specifically regulated (e.g., even when the Co amount is not increased). In general, the Co content may preferably be in a range of from 4 to 10 wt. %. When the Co content is less than 4 wt. % the toughness is considerably decreased. On the other hand, when the Co content exceeds 10 wt. %, the resistance to plastic deformation is decreased.

(Other components)

The binder phase constituting the cemented carbide according to the present invention may contain, as other hard particles, one or more materials selected from carbides, nitrides or carbonitrides of V or Cr, and/or V, and/or Cr. These "other hard particles" have a function of preventing extraordinary grain growth due to dissolution and precipitation of the fine WC crystals, and the total amount thereof may preferably be in a range of from 0.1 to 3 wt. %. When the total amount of the "other hard particles" is less than 0.1 wt. % in the entire metal, the effect of preventing the grain growth is insufficient. On the other hand, when the total amount thereof exceeds 3 wt. %, they can adversely affect the strength of the cemented carbide. Accordingly, the content of "other hard particles" may preferably be in a range of from 0.1 to 3 wt. % on the basis of the entire cemented carbide.

Further, the cemented carbide substrate material according to the present invention may contain one or more carbides of Ti, Nb, or Ta and/or a solid solution of these materials. The one or more carbides of Ti, Nb, or Ta and/or the solid solution thereof have a function of improving the strength, hardness at high temperature, thermal conductivity, and resistance to crater (resistance to wear) of the cemented carbide. However, when an excessively large amount of these carbides are added to the substrate material for coated cemented carbide according to the present invention, the strength of the cemented carbide can rather be decreased. Accordingly, the content of these carbides and their solid solution may preferably be 5 wt. % or less in total.

Preparation of cemented carbide substrate material

The substrate material for coated cemented carbide according to the present invention may be prepared by mixing WC powder as starting powder while controlling the particle size thereof in accordance with desired particle sizes of fine particles and coarse particles of WC crystals, and sintering the resultant mixture of WC powder together with Co powder, etc.

As the sintering method to be used at this time, ordinary vacuum sintering may be of course employed. In addition, when the sintering is conducted by using hot isostatic press (HIP) sintering or SINTER-HIP sintering, the resultant cemented carbide may be caused to have a transverse rupture strength of 300 kg/mm$^2$ or more thereby to further enhance the cutting performance.

Characteristics of cemented carbide substrate material

In addition to the above-mentioned features, the cemented carbide according to the present invention has excellent resistance to thermal shock. This thermal shock resistance is expressed by the following formula (Formula 1).

<Formula 1 >

$$\Delta T = K \times \sigma k / \alpha E$$

($\Delta T$: thermal shock resistance, $\sigma$: transverse rupture strength, $\alpha$: thermal expansion coefficient, k: thermal conductivity, E: Young's modulus of elasticity, K: constant)

In the substrate material for coated cemented carbide according to the present invention, the transverse rupture strength $\sigma$ becomes larger since the size of defect is reduced on the basis of the fine WC particles; the thermal conductivity k is large since the mean free path of the binder phase for transmitting heat is long; and the Young's modulus of elasticity E and the thermal expansion coefficient $\alpha$ are substantially equivalent to those of an ordinary cemented carbide. Accordingly, the above formula (Formula 1) may explain why the thermal shock resistance of the cemented carbide substrate material according to the present invention is so excellent.

It is generally known that the transverse rupture strength of a cemented carbide is decreased when the cemented carbide is coated with a ceramic layer. The reason for this is considered that a crack is introduced at the time of cooling after the coating, on the basis of a difference in the thermal expansion coefficient between the substrate material and the coating layer, and the resultant crack functions as a source for concentration in a manner similar to the case of a Griffith's crack (Hisashi Suzuki, "Cemented carbide and Sintered Hard Material", page 213, published by Maruzen K.K. may be referred to). In this case, the depth of a crack functioning as a stress concentration source may be considered as (the thickness of the coating layer)+(the depth of the crack penetrating into the cemented carbide substrate material)}. Accordingly, the transverse rupture strength of the coated cemented carbide may be expressed by the following formula (formula 2).

<Formula 2>

$$\sigma_m^{-1} = \sigma_o^{-1} + K(d_c + d_w)^{1/2}$$

($\sigma_m$: the transverse rupture strength of the coated cemented carbide, $\sigma_o$: the transverse rupture strength of the cemented carbide substrate material, $d_c$: the thickness of the coating layer, $d_w$: the depth of the crack penetrating into the cemented carbide substrate material, K: constant)

In the cemented carbide according to the present invention, since the transverse rupture strength $\sigma_0$ is large on the basis of the presence of the fine WC particles and the fracture toughness is large on the basis of the coarse WC particles, the crack is less liable to reach a deep interior of the substrate material and the depth of the crack penetrating into the cemented carbide substrate material ($d_w$) becomes small. Accordingly, a coated cemented carbide comprising the cemented carbide according to the present invention as the substrate material may reduce the decrease in the transverse rupture strength, even after the coating thereof with a ceramic layer, as compared with that in the case of conventional cemented carbide, and therefore such a coated cemented carbide may effectively prevent initial breakage thereof.

In addition, in the interior of the cemented carbide according to the present invention, since the fracture toughness becomes greater on the basis of the presence of the coarse WC particles, the propagation of a crack may be retarded, even when such a crack is once introduced, and there may be provided an effect of retarding the propagation of destruction. Accordingly, when the coated cemented carbide according to the present invention is used in wet cutting, in intermittent turning, or in milling wherein a tool is particularly susceptible to thermal shock, the propagation of a fatigue crack may be prevented particularly effectively.

Figure 3:
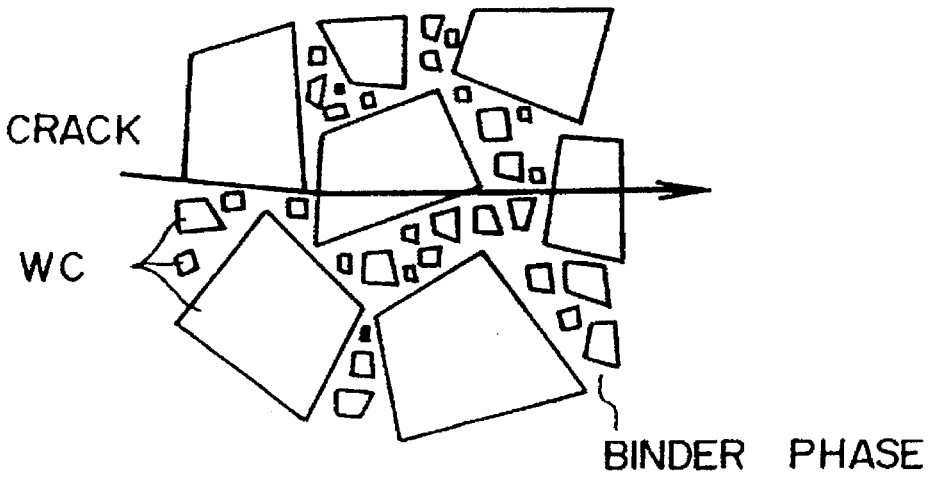
FIG. 3 is a schematic cross sectional view showing a state of the propagation of a crack in a WC coarse particle.
Figure 4:
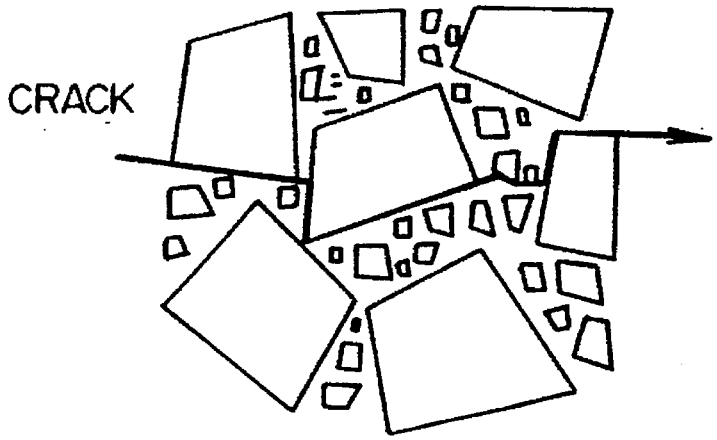
FIG. 4 is a schematic cross sectional view showing a state of propagation of a crack along a phase boundary between WC particles and a binder phase.

The present inventors have actually conducted cutting by use of a coated cemented carbide comprising both of the fine particles and the coarse particles, and have observed a state of the propagation of the resultant crack in more detail. As a result, it has been confirmed that the crack is propagated so as to provide a larger amount of bends (curves and/or crooks) as compared with that in a conventional cemented carbide, and that the quantity of energy to be consumed by the propagation of the crack is increased on the basis of the addition of the coarse WC particles to the cemented carbide. In this case, when the cemented carbide is observed more finely or microscopically, it has been found that a crack is often propagated through a coarse WC particle, as shown in FIG. 3. It has also been found that the crack is preferably caused to propagate through or along a phase boundary between a WC particle and a binder phase, as shown in FIG. 4, for the purpose of maximizing the effect of a cemented carbide structure to which coarse WC particles have been added.

As a result of earnest study on a method for controlling the propagation of a crack in such a manner, the present inventors have found that the following two methods are particularly effective. Thus, one of such two methods is to cause a cemented carbide substrate material to have a low carbon content, and the other method is to add Ni and/or Fe to a cemented carbide substrate material. According to the present inventors' investigation, it has been found that the wettability between the binder phase and WC is decreased when either of the above methods is used; based on such a decrease in wettability, a crack propagating due to fatigue is caused to have a tendency to detour around a coarse WC particle through the phase boundary between WC and the binder phase, as shown in FIG. 4; and the cutting service life until breakage may further be prolonged in the coated cemented carbide containing the coarse WC particles according to the present invention.

According to the present inventors' investigation, it has been found that, in the substrate material for coated cemented carbide according to the present invention, the effect of suppressing the propagation of a crack is particularly great when the following relationship is satisfied:

$$-0.5 \leqq (X-b)/(a-b) \leqq 0.67$$

(preferably, $-0.5 \leqq (X-b)/(a-b) \leqq 0.5$), wherein X denotes the amount of carbon contained in the cemented carbide, a denotes the lower limit of carbon content at which free carbon occurs, and b denotes the upper limit of carbon content at which an η phase occurs (where X, a, and b are represented by wt. %). When the value of (X–b)/(a–b) is less than –0.5, the strength of the cemented carbide itself is decreased. On the other hand, when the value of (X–b)/(a–b) exceeds 0.67, the effect of controlling the carbon content in the cemented carbide is not provided.

The above-mentioned lower limit a of carbon content for causing free carbon, and the upper limit b of carbon content for causing an η phase are carbon contents which depend on the composition of the hard phase components and the composition of the binder phase components in the cemented carbide system. These carbon contents may be determined experimentally.

More specifically, for example, cemented carbides are prepared so as to provide different carbon contents in the respective metal compositions, and the hard phase contents, the binder phase contents, and the carbon contents are respectively determined. Simultaneously, an arbitrary cross section of each cemented carbide is mirror-polished to provide a texture thereof and is then etched (in a similar manner as in the measurement of the area ratio of the WC particles as described hereinabove), and the precipitation of an η phase and free carbon in the resultant texture is observed with an optical microscope thereby to determine the lower limit a of carbon content for causing free carbon, and the upper limit b of carbon content for causing an η phase.

In the present invention, in a case where Ni and/or Fe is added to the substrate material, when the addition amount of Ni and/or Fe is less than 0.1 wt. %, the effect of suppressing the propagation of a crack is insufficient. On the other hand, when the addition amount exceeds 10 wt. %, the effect of suppressing the propagation of a crack is substantially unchanged, but a decrease in the resistance to plastic deformation is observed in high-speed cutting. Accordingly, in a case where Ni and/or Fe is added to the substrate material, the addition amount of Ni and/or Fe may preferably be in a range of from 0.1 to 10 wt. %.

According to the present inventors' investigation, it has been confirmed that the resistance to the propagation of a crack is improved, when 0.1 to 15 wt. % of a nitride and/or a carbide/nitride of one or more metals selected from group IVa, Va, and Via elements in the periodic table is added into the cemented carbide substrate material according to the invention. According to the present inventors' knowledge, it is presumed that such a phenomenon is based on a decrease in the wettability between WC and the binder phase, or on a low wettability between the nitride and the carbide/nitride, and the binder phase.

In a case where the above nitride and/or carbide/nitride of one or more metals selected from IVa, Va, and VIa groups in the periodic table is added in the amount of 0.1 to 15 wt. %, the grain growth of WC is suppressed, and therefore the strength of the alloy is improved, and the resistance thereof to cratering wear (wear causing a crater) is also improved. Particularly, when a nitride and/or carbide/nitride of one or more metals selected from Zr, Ta, and Nb is added, these effects may further be enhanced in a preferable manner. When the addition amount of the nitride and/or carbide/nitride is less than 0.1 wt. %, the above effect is insufficient. On the other hand, when the addition amount exceeds 15 wt. %, the strength of the alloy is remarkably decreased. Accordingly, when the nitride and/or carbide/nitride of one or more metals selected from Zr, Ta, and Nb is added to the alloy, the (total) addition amount may preferably be in a range of from 0.1 to 15 wt. %.

In addition, when a β phase-reduced layer is caused to be formed at the surface of the substrate material for coated cemented carbide according to the present invention, a coarse WC particle is present in the β phase-reduced layer, and the propagation of a crack is prevented more effectively as compared with that in the case of a conventional cemented carbide, in addition to the effect of an increase in the quantity of the binder phase, whereby the effect of suppressing initial occurrence of a crack becomes great. Accordingly, such a β phase-reduced layer is caused to be formed, there may be provided a coated cemented carbide which is more resistant to initial breakage. In addition, in such a case, since the resistance thereof to the propagation of a crack is increased in the interior of the cemented carbide, there may be provided a coated cemented carbide which is also resistant to fatigue breakage. In other words, in a region in the neighborhood of the surface of a cemented carbide substrate material, when there is formed a 5 to 50 μm-thick phase such that a carbide, a nitride, or a carbide/nitride of one or more metals selected from IVa, Va, and VIa groups (except for WC) and/or a solid solution thereof, is not present or is decreased as compared with that in the interior of the cemented carbide, there may be provided a substrate material for coated cemented carbide having a better property. However, when the thickness of such a phase is less than 5 μm, the effect thereof is insufficient. On the other hand, when the thickness exceeds 50 μm, the resistance to plastic deformation is remarkably reduced in an undesirable manner.

As described above, the coated cemented carbide according to the present invention uses, as a substrate material to be coated, a cemented carbide substrate material comprising at an optimum ratio the two kinds of WC particles which are clearly different in the particle sizes thereof (for example, coarse particles having an average particle size which is at least 5 times larger than that of fine particles). Accordingly, the coated cemented carbide according to the present invention has well-balanced strength and toughness, has an excellent resistance to thermal shock, exhibits a small decrease in the strength thereof after the formation of a coating layer to be disposed thereon, and is highly resistant to the propagation of a fatigue crack. As a result, the cemented carbide according to the present invention has an excellent property as a coated cemented carbide, particularly as a coated cemented carbide to be used for cutting.

Coated cemented carbide for cutting

As a coated cemented carbide for cutting general steel and a hard-to-machine material, those having a particularly excellent property is specifically described below.

(1) A coated cemented carbide comprising: a WC-based cemented carbide as a substrate material containing 4 to 10 wt. % of Co as a binder phase, and a coating layer having a total thickness of 5 to 100 μm disposed on a surface of the cemented carbide. In the cemented carbide substrate material, at least 80% of the WC crystals are classified into either one of a group of fine particles A having a particle size of from 0.1 to 1 μm and a group of coarse particles B having a particle size of from 3 to 10 μm, and the area ratio $S_A/S_B$ of the fine particles A to the coarse particles B is in a range of from 0.22 to 0.45, on a mirror-polished texture of an arbitrary cross section of the cemented carbide. The coating layer comprises a single layer or a plurality of layers comprising a carbide, a nitride, a carbide/nitride, a carbide/oxide, or a boride/nitride of Ti, Zr, and/or Hf; and a single layer or a plurality of layers comprising an oxide of Ti, Zr, or Hf, or $Al_2O_3$. Such a coated cemented carbide exhibits a particularly excellent performance in the cutting of general steel. Particularly, a conventional coated cemented carbide having a ceramic layer with a thickness of 20 μm or more has not been put into practice, since it shows only a low resistance to breakage. However, according to the present invention, such a coated cemented carbide may be put into practice and may show an excellent performance in high-speed cutting of steel.

The above-described coating layer may be formed by using an ordinary chemical vapor deposition process (CVD process) or an ordinary physical vapor deposition process (PVD process). When the thickness of the entire coating layer is less than 5 μm, the improvement in the wear resistance based on the formation of the coating layer is insufficient. On the other hand, when the thickness of the coating layer exceeds 100 μm, the resistance to breakage is reduced as a coated cemented carbide. Accordingly, the thickness of the entire coating layer as described above may preferably be in a range of from 5 to 100 μm.

(2) A coated cemented carbide comprising: a WC-based cemented carbide as a substrate material containing 4 to 10 wt. % of Co as a binder phase, and a coating layer having a total thickness of 0.2 to 10 μm disposed on a surface of the cemented carbide. In the cemented carbide substrate material, at least 80% of the WC crystals are classified into either one of a group of fine particles A having a particle size of from 0.1 to 1 μm and a group of coarse particles B having a particle size of from 3 to 10 μm; the area ratio $S_A/S_B$ of the fine particles A to the coarse particles B is in a range of from 0.22 to 0.45, on a mirror-polished texture of an arbitrary cross section of the cemented carbide; and when the amount of carbon contained in the cemented carbide is denoted by X, the lower limit of carbon content for forming free carbon is denoted by a, and the upper limit of carbon content for forming an η phase is denoted by b (where X, a, and b are represented by wt. %), a relationship of $-0.5 \leqq (X-b)/(a-b) \leqq 0.67$ is satisfied. The coating layer comprises a single layer or a plurality of layers comprising a carbide, a nitride, or a carbide/nitride of Ti, or a carbide, a nitride, or a carbide/nitride of an alloy of Ti and Al. Such a coated cemented carbide is particularly suitably be used for a cutting tool for a hard-to-machine material.

The above-described coating layer may be formed by using an ordinary chemical vapor deposition process (CVD process) or an ordinary physical vapor deposition process (PVD process). Among them, a coated cemented carbide comprising a coating layer formed by a physical vapor deposition process has a compression residual stress in the coating layer, and therefore a crack is less liable to be introduced thereinto, and the cemented carbide may maintain excellent strength and toughness of a cemented carbide as a substrate material even after the coating. Accordingly, such a coated cemented carbide is less liable to cause chipping even in the cutting of a hard-to-machine material, and further in combination with an improvement in resistance to welding provided by the coating layer, and the coated cemented carbide may remarkably prolong the service life of a tool in the cutting of a hard-to-machine material.

When the thickness of the entire coating layer is less than 0.2 μm, the effect of the coating is insufficient. On the other hand, when the thickness of the coating layer exceeds 10 μm, the strength is liable to be decreased. Accordingly, the thickness of the entire coating layer as described above may preferably be in a range of from 0.2 to 10 μm.

Contents of respective components, etc.

The values of contents, etc., of the respective components or constituents described in the present specification and claims may be determined, e.g., by subjecting a sintered product to quantitative analysis to obtain the contents of the components in the following manner:

Co: potentiometric titration (measuring apparatus: "KY8" (trade name), manufactured by Yanagimoto K.K.; reference: "Handbook of Analytical Chemistry" (third revised edition), p.102, edited by the Japan. Society for Analytical Chemistry) Ni, Ti, Ta, Nb, Zr, etc.: ICP method (inductively coupled plasma atomic emission spectrometry) (measuring apparatus: "SPS1200VR" (trade name), manufactured by Seiko Densi Kogyo K.K.)

C: thermal conductivity method (measuring apparatus: "WR112" manufactured by LECO Co.), O (infrared absorption method), N (thermal conductivity method), (measuring apparatus: "TC136", LECO Co.)

Fe: atomic absorption spectrometry (measuring apparatus: Z-6100 (trade name), manufactured by Hitachi Seisakusho, reference: Tsugio Takeuchi, "Atomic Absorption Spectrometry" published by Nankodo; polarization Zeeman-effect atomic absorption, Hitachi Seisakusho, "Hitachi Physical and Chemical Instrumental Analysis Data" p.263)

Further, the presence of a "solid solution" may be confirmed by X-ray qualitative analysis (reference: Eiichi Asada, "X-ray Analysis" p.90 (Kyoritsu Shuppan)).

Hereinbelow, the present invention will be described in more detail with reference to Examples.

EXAMPLE 1

Commercially available fine WC powder having an average particle size of 0.5 μm, Co powder, $Cr_3C_2$ powder, VC powder and coarse WC powder having an average particle size of 5 μm were provided. These starting material powders were subjected to wet mixing by using a ball mill for 24 hours, and then dried and press-molded under a pressure of 1.5 kg/cm$^2$. Then, the pressed powder product thus obtained was sintered in vacuum at 1450° C., and thereafter was subjected to an HIP treatment under a pressure of 1000 kg/cm$^2$.

While the ratio of the fine particles to the coarse particles to be used as WC powder was regulated, plural species of cemented carbides having different particle size distributions of WC crystals as a hard phase were prepared in accordance with the above process.

Table 1 as described below shows ratios of the fine particles A having a particle size of from 0.1 to 1.0 μm in WC crystals, the coarse particles B having a particle size of from 3.0 to 10 μm in WC crystals, and Co, Cr, and V with respect to the entire alloy, and ratios (area ratios) $S_A/S_B$ of the fine WC particles A to the coarse WC particles B, for the respective cemented carbides thus prepared. The particle size distribution of WC crystals in the cemented carbide was measured on the basis of observation of a mirror-polished texture of the cemented carbide with an optical microscope or a scanning electron microscope, as described hereinabove.

In the case of "Sample No. 8" according to the present invention as shown in Table 1, V was present in the cemented carbide partially in the form of a carbide thereof, and in the case of another "Sample No. 11" according to the present invention, Cr was present in the cemented carbide partially in the form of a carbide thereof.

Each of the cemented carbides thus obtained was used as a substrate material, a coating layer was formed on the surface of the substrate material by using an ordinary CVD process (as disclosed in Japanese Patent Publication No. 3234/1987, i.e., Sho 62-3234) in accordance with Table 2 as described below.

Each of the thus prepared coated cemented carbides (each in a combination of a substrate material and a coating layer as listed in Tables 3 and 4 described below) was formed into a cutting tool having a shape of "Model SNMG 120412" according to the Japanese Industrial Standard (JIS), and the performances thereof were evaluated under the following two kinds of cutting conditions, by use of a workpiece (a material to be cut) of "SCM415 (HB180)" according to JIS. In each of the evaluation tests, the period until the time at which the flank wear reached 0.2 mm or the time at which a breakage occurred was measured as a cutting service life. All of the results thus obtained are listed in Tables 3 and 4 described below.

Test conditions 1 (3-second repetitive turning operations)

Cutting speed: 500 m/min

Feed rate: 0.5 mm/rev

Depth of cut: 1.5 mm

Wet cutting

Test conditions 2 (intermittent turning operations of 4v-channel steel)

Cutting speed: 250 m/min

Feed rate: 0.4 mm/rev

Depth of cut: 1.5 mm

Wet cutting

As shown by the results in the above Tables 3 and 4, it was found that each of the cutting tools comprising a coated cemented carbide sample according to the present invention, which comprised a cemented carbide substrate material comprising the fine WC particles and coarse WC particles, and a coating layer formed on a surface of the substrate material and comprising an oxide, was excellent both in the wear resistance and in the resistance to breakage in the cutting of general steel, and was improved in the cutting performance.

Incidentally, when each of the cemented carbides shown in Table 1 was used alone for a cutting tool (without forming a coating layer to be disposed thereon), a loss of the tool was caused within one second counted from the start of machining under either set of the Cutting Conditions 1 and 2. As a result, the cemented carbide as such could not be used as a cutting tool at all.

TABLE 1

| Sample No. | $S_A/S_B$ | (A + B)/WC | Co wt % | Cr wt % | V wt % | $\frac{x-b}{a-b}$ |
|---|---|---|---|---|---|---|
| 1* | 0.14 | 95 | 6 | 0.5 | | 0.7 |
| 2* | 1.0 | 87 | 6.5 | | | 0.6 |
| 3* | 0.45 | 70 | 6.5 | | | 0.75 |
| 4 | 0.38 | 93 | 6 | 0.5 | | 0.74 |
| 5 | 0.22 | 91 | 6.5 | | | 0.68 |
| 6 | 0.45 | 100 | 6.5 | | | 0.7 |
| 7 | 0.34 | 89 | 6 | 0.1 | | 0.8 |
| 8 | 0.34 | 80 | 6 | | 3 | 0.74 |
| 9 | 0.34 | 90 | 10 | 1.5 | 1.5 | 0.68 |
| 10 | 0.22 | 86 | 4 | | 0.1 | 0.67 |
| 11 | 0.22 | 80 | 7 | 3 | | 0.67 |

TABLE 2

| Coating Layer No. | 1st Layer (μm) | 2nd Layer (μm) | 3rd Layer (μm) | 4th Layer (μm) | 5th Layer (μm) |
|---|---|---|---|---|---|
| A* | TiC (50) | $Al_2O_3$ (60) | — | — | — |
| B* | TiCN (1) | $ZrO_2$ (3) | — | — | — |
| C* | TiCN (5) | TiC (5) | TiN (5) | — | — |
| D | TiC (5) | TiBN (0.5) | $Al_2O_3$ (5) | TiN (0.5) | — |
| E | TiCN (10) | $Al_2O_3$ (20) | $ZrO_2$ (5) | — | — |
| F | TiCN (20) | TiCO (2) | $Al_2O_3$ (40) | $HfO_2$ (10) | TiN (1) |
| G | TiN (1) | ZrN (2) | TiCN (10) | HfC (20) | $Al_2O_3$ (20) |
| H | TiN (1) | ZrN (5) | TiCN (5) | HfCN (5) | $HfO_2$ (5) |
| I | TiN (1) | (TiHf)CN (3) | TiBN (0.5) | $Al_2O_3$ (0.5) | — |
| J | TiN (1) | (TiZr)CN (10) | $Al_2O_3$ (60) | (TiHf)CN (25) | TiN (4) |

TABLE 3

| | Cutting Life (Min.) | | | | | | | | | |
|---|---|---|---|---|---|---|---|---|---|---|
| | A* | B* | C* | D | E | F | G | H | I | J |
| 1* | 4.0 | 1.0 | 1.5 | 3.6 | 3.1 | 2.2 | 1.3 | 1.5 | 3.5 | 0.3 |
| 2* | 3.0 | 1.5 | 2.0 | 3.9 | 4.0 | 1.0 | 0.7 | 0.3 | 4.0 | 0.5 |
| 3* | 3.5 | 2.3 | 2.5 | 4.0 | 4.8 | 1.0 | 0.3 | 0.5 | 4.0 | 0.5 |
| 4 | 4.3 | 2.1 | 1.2 | 5.9 | 8.9 | 6.5 | 9.7 | 7.8 | 6.0 | 9.0 |
| 5 | 4.5 | 2.1 | 1.8 | 6.0 | 9.0 | 7.0 | 10.5 | 6.5 | 7.0 | 9.8 |
| 6 | 5.0 | 2.0 | 2.0 | 5.8 | 8.5 | 6.8 | 10.2 | 8.0 | 6.5 | 8.0 |
| 7 | 4.6 | 1.9 | 1.8 | 6.4 | 10.0 | 9.0 | 15.0 | 7.9 | 6.4 | 10.0 |
| 8 | 4.9 | 2.0 | 1.9 | 6.8 | 10.5 | 10.0 | 18.0 | 9.0 | 6.5 | 10.5 |
| 9 | 4.5 | 2.0 | 2.0 | 6.0 | 9.4 | 14.0 | 20.0 | 7.0 | 6.0 | 13.0 |
| 10 | 5.2 | 2.4 | 2.2 | 7.5 | 11.5 | 18.0 | 20.0 | 11.0 | 7.0 | 12.0 |
| 11 | 5.3 | 2.2 | 2.4 | 7.0 | 11.2 | 16.0 | 20.0 | 8.0 | 6.8 | 14.0 |

Samples surrounded by a box are those according to the present invention

TABLE 4

| | Cutting Life (Min.)hz,1/50 | | | | | | | | | |
|---|---|---|---|---|---|---|---|---|---|---|
| | A* | B* | C* | D | E | F | G | H | I | J |
| 1* | 0.1 | 0.2 | 0.2 | 2.4 | 1.9 | 0.7 | 0.4 | 0.8 | 1.9 | 0.2 |
| 2* | 0.2 | 0.3 | 0.3 | 1.0 | 1.0 | 0.3 | 0.2 | 0.6 | 1.1 | 0.4 |
| 3* | 0.1 | 0.2 | 0.2 | 1.5 | 1.2 | 0.4 | 0.6 | 1.0 | 1.3 | 0.3 |
| 4 | 0.8 | 1.5 | 0.9 | 6.2 | 4.5 | 3.2 | 3.9 | 5.4 | 7.0 | 4.0 |
| 5 | 0.9 | 1.9 | 1.9 | 8.0 | 6.0 | 5.0 | 4.0 | 4.8 | 8.5 | 4.5 |
| 6 | 1.0 | 1.8 | 1.8 | 7.5 | 6.0 | 5.4 | 4.6 | 5.0 | 7.0 | 5.1 |
| 7 | 0.8 | 1.6 | 1.5 | 8.0 | 6.3 | 6.0 | 5.0 | 5.5 | 7.7 | 5.3 |
| 8 | 1.0 | 1.5 | 1.5 | 7.8 | 7.5 | 7.0 | 5.8 | 6.0 | 8.0 | 6.1 |
| 9 | 1.2 | 1.8 | 1.4 | 9.8 | 8.0 | 8.5 | 8.0 | 8.0 | 10.5 | 9.5 |
| 10 | 0.7 | 1.6 | 1.5 | 7.0 | 7.0 | 7.1 | 7.0 | 7.0 | 8.0 | 7.1 |
| 11 | 0.9 | 1.2 | 1.5 | 8.5 | 7.8 | 7.9 | 7.0 | 6.5 | 7.8 | 6.6 |

Samples surrounded by a box are those according to the present invention

EXAMPLE 2

Commercially available fine WC powder having an average particle size of 0.5 μm, Co powder, TiC powder, TaC powder, NbC powder, $Cr_3C_2$ powder, VC powder and coarse WC powder having an average particle size of 5 μm, were provided. These starting material powders were subjected to wet mixing by using a ball mill for 24 hours, and then dried and press-molded under a pressure of 1.5 kg/cm$^3$. Then, the pressed powder product thus obtained was sintered in vacuum at 1450° C., and thereafter was subjected to an HIP treatment under a pressure of 1000 kg/cm$^2$.

While the ratio of the fine particles to the coarse particles to be used as WC powder was regulated, plural species of cemented carbides having different particle size distributions of WC crystals as a hard phase were prepared in accordance with the above process.

Table 5 as described below shows ratios of the fine particles A having a particle size of from 0.1 to 1.0 μm in WC crystals, the coarse particles B having a particle size of from 3.0 to 10 μm in WC crystals, and Co, Cr, and V with respect to the entire alloy, composite carbide contents (TIC, TaC and NbC contents), and ratios (area ratios) $S_a/S_B$ of the fine WC particles A to the coarse WC particles B, for the respective cemented carbides thus prepared. The particle size distribution of WC crystals in the cemented carbide was measured on the basis of observation of a mirror-polished texture of the cemented carbide with an optical microscope and a scanning electron microscope, in the same manner as in Example 1.

In the case of "Sample Nos. 12–15" according to the present invention containing two or more species of composite carbides as shown in Table 5, these carbides were present in the cemented carbide in the form of a mutual solid solution carbide, and in the case of other Samples, W was present somewhat in the form of a solid solution in the composite carbide.

In addition, in Sample Nos. 14 and 18, V was present in the cemented carbide partially in the form of a carbide thereof, and in Sample No. 15 according to the present invention, Cr was present in the cemented carbide partially in the form of a carbide thereof.

TABLE 5

| Sample No. | $S_A/S_B$ | (A + B)/WC % | TiC wt % | TaC wt % | NbC wt % | Co wt % | Cr wt % | V wt % | (X − b)/(a − b) |
|---|---|---|---|---|---|---|---|---|---|
| 12* | 0.40 | 89 | 2 | 2 | 2 | 10 | | | 0.7 |
| 13* | 0.34 | 88 | 9 | 2 | 1 | 10 | 3 | | 1.69 |
| 14* | 0.45 | 88 | 7 | 2 | | 8 | | 3 | 0.8 |
| 15 | 0.34 | 80 | 2 | 1.5 | 1.5 | 10 | 2.0 | 1.0 | 0.7 |
| 16 | 0.22 | 89 | 5 | | | 8 | | | 0.85 |
| 17 | 0.45 | 88 | | 5 | | 4 | 0.1 | | 0.7 |
| 18 | 0.34 | 90 | | | 5 | 8 | | 3 | 0.69 |

Each of the cemented carbides thus obtained was used as a substrate material, a coating layer was formed on the surface of the substrate material in the same manner as in Example 1 in accordance with Table 2 in Example 1 (Coating layers A, B and E to J) as described above.

Each of the thus prepared coated cemented carbides (each in a combination of a substrate material and a coating layer as listed in Tables 3 and 4 described above) was formed into a cutting tool having a shape of "Model SNMG 120412", and cutting performances thereof were evaluated in the same manner as in Example 1 thereby to determine the cutting service life thereof. All of the results thus obtained are listed in Tables 6 and 7 described below.

As shown by the results in the Tables 6 and 7, it was found that each of the cutting tools comprising a coated cemented carbide sample according to the present invention, which comprised a cemented carbide substrate material comprising the fine WC particles and coarse WC particles, and a coating layer formed on a surface of the substrate material and comprising an oxide, was excellent both in the wear resistance and in the resistance to breakage in the cutting of general steel, and was improved in the cutting performance.

Incidentally, when each of the cemented carbides shown in Table 5 was used alone for a cutting tool without forming a coating layer to be disposed thereon, a loss of the tool was caused within one second counted from the start of machining under either set of the Cutting Conditions 1 and 2. As a result, the cemented carbide as such could not be used as a cutting tool at all.

TABLE 6

Cutting Condition 1
Cutting Life (Min.)

| | A* | B* | E | F | G | H | I | J |
|---|---|---|---|---|---|---|---|---|
| 12* | 3.0 | 2.0 | 2.8 | 3.0 | 4.5 | 3.0 | 2.5 | 4.3 |
| 13* | 3.5 | 3.0 | 3.3 | 3.8 | 4.8 | 4.5 | 3.2 | 4.2 |
| 14* | 4.0 | 3.8 | 4.0 | 4.2 | 5.0 | 4.3 | 4.0 | 3.0 |
| 15 | 4.2 | 4.0 | 7.0 | 5.5 | 6.0 | 5.9 | 6.5 | 8.0 |
| 16 | 4.5 | 4.2 | 10.0 | 9.0 | 7.0 | 6.2 | 7.0 | 14.0 |
| 17 | 4.0 | 3.6 | 16.0 | 13.0 | 18.0 | 5.6 | 5.9 | 20.0 |
| 18 | 3.8 | 3.5 | 13.5 | 14.2 | 12.0 | 6.4 | 8.0 | 9.0 |

Samples surrounded by a box are those according to the present invention

TABLE 7

| | Cutting Condition 2 Cutting Life (Min.) | | | | | | | |
|---|---|---|---|---|---|---|---|---|
| | A* | B* | E | F | G | H | I | J |
| 12* | 0.1 | 1.0 | 1.4 | 1.5 | 2.4 | 2.4 | 4.0 | 2.1 |
| 13* | 0.1 | 1.4 | 1.6 | 1.8 | 3.0 | 2.4 | 3.5 | 1.3 |
| 14* | 0.1 | 0.8 | 1.2 | 1.2 | 1.8 | 1.7 | 4.8 | 0.9 |
| 15 | 0.8 | 1.8 | 5.0 | 8.0 | 7.5 | 6.9 | 10.2 | 8.0 |
| 16 | 0.9 | 2.0 | 5.2 | 6.1 | 6.0 | 6.8 | 8.0 | 7.5 |
| 17 | 0.8 | 2.4 | 4.9 | 4.8 | 5.3 | 7.5 | 15.0 | 10.1 |
| 18 | 1.0 | 2.0 | 6.1 | 6.0 | 5.4 | 7.5 | 9.0 | 10.5 |

Samples surrounded by a box are those according to the present invention

EXAMPLE 3

The Sample Nos. 6, 7, 15 and 17 obtained in Examples 1 and 2 were used, while changing the carbon content (x) in the alloy in a range satisfying ((x–b)/(a–b))=–0.5, 0, 0.33, and 0.67, and plural species of cemented carbides were prepared.

Coating layers I and J as shown in Example 1 were formed on the surfaces of the cemented carbides thus obtained, in the same manner as in Example 1. The performances of the thus obtained coated cemented carbides were evaluated under the same Cutting Conditions as in Example 1. The results are shown in the following Tables 8 and 9.

From the results of the evaluation as described above, it was found that when the carbon content (x) in the alloy is controlled in a range satisfying ((x–b)/(a–b))=–0.5 to 0.67, the effect of the present invention was further enhanced so as to improve the cutting performance. It was also found that such an effect was particularly remarkable in a range satisfying ((x–b)/(a–b))=–0.5 to 0.5.

TABLE 8

| Sample | Cutting Condition 1 Cutting Life (Min.) (x – b)/(a – b) | | | | |
|---|---|---|---|---|---|
| No. | –0.5 | O | 0.33 | 0.5 | 0.67 |
| 6I | 18.1 | 14.3 | 10.0 | 8.3 | 7.5 |
| 7I | 17.9 | 12.3 | 10.5 | 8.0 | 7.0 |
| 15I | 9.0 | 9.5 | 10.0 | 8.9 | 8.0 |
| 17I | 9.8 | 9.8 | 9.0 | 7.5 | 6.8 |
| 6J | 19.0 | 18.8 | 15.5 | 12.3 | 9.0 |
| 7J | 17.4 | 17.2 | 15.5 | 13.8 | 12.0 |
| 15J | 12.5 | 12.1 | 11.5 | 10.3 | 9.5 |
| 17J | 27.0 | 25.5 | 25.8 | 24.0 | 22.0 |

TABLE 9

| Sample | Cutting Condition 2 Cutting Life (Min.) (x – b)/(a – b) | | | | |
|---|---|---|---|---|---|
| No. | –0.5 | O | 0.33 | 0.5 | 0.67 |
| 6I | 8.8 | 10.0 | 13.2 | 10.8 | 8.5 |

TABLE 9-continued

| Sample | Cutting Condition 2 Cutting Life (Min.) (x – b)/(a – b) | | | | |
|---|---|---|---|---|---|
| No. | –0.5 | O | 0.33 | 0.5 | 0.67 |
| 7I | 9.5 | 13.3 | 15.0 | 11.3 | 9.0 |
| 15I | 16.5 | 19.0 | 19.9 | 17.0 | 12.5 |
| 17I | 16.0 | 19.3 | 19.8 | 18.2 | 16.0 |
| 6J | 9.0 | 9.8 | 9.5 | 9.0 | 6.5 |
| 7J | 8.9 | 9.3 | 9.5 | 9.0 | 6.8 |
| 15J | 8.5 | 9.0 | 9.6 | 10.3 | 9.5 |
| 17J | 11.5 | 11.9 | 12.6 | 13.0 | 12.0 |

EXAMPLE 4

Commercially available fine WC powder having an average particle size of 0.5 μm, Co powder, Ni powder, Fe powder, $Cr_3C_2$ powder, VC powder, TiC powder, NbC powder, TaC powder and coarse WC powder having an average particle size of 5 μm were provided. These starting material powders were subjected to wet mixing by using a ball mill for 24 hours, and then dried and press-molded under a pressure of 1.5 kg/cm$^2$. Then, the pressed powder product thus obtained was sintered in vacuum at 1450° C., and thereafter was subjected to an HIP treatment under a pressure of 1000 kg/cm$^2$.

While the ratio of the fine particles to the coarse particles to be used as WC powder was regulated, plural species of cemented carbides having different particle size distributions of WC crystals as a hard phase were prepared in accordance with the above process.

Table 10 as described below shows ratios of the fine particles A having a particle size of from 0.1 to 1.0 μm in WC crystals, the coarse particles B having a particle size of from 3.0 to 10 μm in WC crystals, ratios (area ratios) $S_A/S_B$ of the fine WC particles A to the coarse WC particles B, and compositions for the respective cemented carbides thus prepared. The particle size distribution of WC crystals in the cemented carbide was measured in the same manner as in Example 1 on the basis of observation of a mirror-polished texture of the cemented carbide with an optical microscope and a scanning electron microscope, as described hereinabove.

In the case of "Sample Nos. 21, 26, 27 and 30" containing two or more species of composite carbides, these carbides were present in the cemented carbide in the form of a mutual solid solution carbide, and in the case of each of Sample Nos. 21 and 26–35, W was present somewhat in the form of a solid solution in the composite carbide.

In addition, in Sample No. 29 according to the present invention, V was present in the cemented carbide partially in the form of a carbide thereof, and in Sample Nos. 31–35 according to the present invention, Cr was present in the cemented carbide partially in the form of a carbide thereof.

Each of the cemented carbides thus obtained was used as a substrate material, a coating layer was formed on the surface of the substrate material by using an ordinary CVD process in the same manner as in Example 1 in accordance with Table 2 in Example 1 (Coating Layers A, B, and E to J) described above.

Each of thus prepared coated cemented carbides (each in a combination of a substrate material and a coating layer as listed in Tables 11 and 12 described below) was formed into a cutting tool having a shape of "Model SNMG 120412", and the performances thereof were evaluated under the above-mentioned two kinds of Cutting Conditions in Example 1 (i.e., "Cutting Conditions 1", and "Cutting Conditions 2") by use of a workpiece of "SCM415 (HB180)". In each of the evaluation tests, the period until the time at which the flank wear reached 0.2 mm or the time at which a breakage occurred was measured as a cutting service life. All of the results thus obtained are inclusively listed in Tables 11 and 12 described below.

As shown by the results in the above Tables 11 and 12, it was found that each of the cutting tools comprising a coated cemented carbide sample according to the present invention, which comprised a cemented carbide substrate material comprising the fine WC particles and coarse WC particles, and a coating layer formed on a surface of the substrate material and comprising an oxide, was excellent both in the wear resistance and in the resistance to breakage in the cutting of general steel, and was improved in the cutting performance.

Incidentally, when each of the cemented carbides shown in Table 10 was used alone for a cutting tool without forming a coating layer to be disposed thereon, a loss of the tool was caused within one second counted from the start of machining under either set of the Cutting Conditions 1 and 2. As a result, the cemented carbide as such could not be used as a cutting tool at all.

EXAMPLE 5

Commercially available fine WC powder having an average particle size of 0.5 μm, Co powder, Ni powder, Fe powder, $Cr_3C_2$ powder, VC powder, TiCN powder, ZrCN powder, HfCN powder, TaCN powder, NbCN powder, TiN powder, ZrN powder, HfN powder, TaN powder, NbN powder and coarse WC powder having an average particle size of 5 μm were provided. These starting material powders were subjected to wet mixing by using a ball mill for 24 hours, and then dried and press-molded under a pressure of 1.5 kg/cm$^2$. Then, the pressed powder product thus obtained was sintered in vacuum at 1450° C. and thereafter was subjected to an HIP treatment under a pressure of 1000 kg/cm$^2$.

While the ratio of the fine particles to the coarse particles to be used as WC powder was regulated, plural species of cemented carbides having different particle size distributions of WC crystals as a hard phase were prepared in accordance with the above process.

Table 13 as described below shows ratios of the fine particles A having a particle size of from 0.1 to 1.0 μm in WC crystals, the coarse particles B having a particle size of from 3.0 to 10 μm in WC crystals, ratios (area ratios) $S_A/S_B$ of the fine WC particles A to the coarse WC particles, and compositions for the respective cemented carbide samples thus prepared. In addition, Table 13 also shows "C (μm)" representing the thickness of a region in each sample wherein a carbide/nitride of a metal selected from the IVa, Va and VIa groups of the periodic table (except for WC) was reduced in the amount thereof or disappeared near the surface of substrate material, as compared with that in the interior of the cemented carbide.

The particle size distribution of WC crystals in the cemented carbide was measured in the same manner as in Example 1 on the basis of observation of a mirror-polished texture of the cemented carbide with an optical microscope and a scanning electron microscope, as described hereinabove.

Each of "Sample Nos. 36 to 43" contained two or more species of composite carbides, and these carbides were present in the cemented carbide in the form of a mutual solid solution carbide. In each of the Samples, W was present somewhat in the form of a solid solution in the composite carbide.

In addition, in Sample Nos.42 according to the present invention, V was present in the cemented carbide partially in the form of a carbide thereof, and in Sample Nos. 39 according to the present invention, Cr was present in the cemented carbide partially in the form of a carbide thereof.

Each of the cemented carbides thus obtained was used as a substrate material, a coating layer was formed on the surface of the substrate material by using an ordinary CVD process in the same manner as in Example 1 in accordance with Table 2 in Example 1 (Coating Layers A, B, and E to J) described above.

Each of the thus prepared coated cemented carbides (each in a combination of a substrate material and a coating layer as listed in Tables 14 and 15 described below) was formed into a cutting tool having a shape of "Model SNMG 120412", and the performances thereof were evaluated under the following two kinds of Cutting Conditions by use of a workpiece of "SCM415 (HB180)". In each of the evaluation tests, the period until the time at which the flank wear reached 0.2 mm or the time at which a breakage occurred was measured as a cutting service life. All of the results thus obtained are inclusively listed in Tables 14 and 15 described below.

Test conditions 3 (3-second repetitive turning operations)
Cutting speed: 300 m/min
Feed rate: 0.8 mm/rev
Depth of cut: 1.5 mm
Wet cutting
Test conditions 4 (intermittent
turning operations of 4v-channel steel)
Cutting speed: 300 m/min
Feed rate: 0.35 mm/rev
Depth of cut: 1.5 mm
Wet cutting As shown by the results in the above Tables 14 and 15, it was found that each of the cutting tools comprising a coated cemented carbide sample according to the present invention, which comprised a cemented carbide substrate material comprising the fine WC particles and coarse WC particles, and a coating layer formed on a surface of the substrate material and comprising an oxide, was excellent both in the wear resistance and in the resistance to breakage in the cutting of general steel, and was improved in the cutting performance.

In addition, among the Samples according to the present invention, it was found that Sample Nos. 40 to 43 containing a nitride or carbide/nitride of Zr, Ta or Nb particularly exhibited excellent performance. Samples having a layer or region wherein a composite carbide was reduced in the amount thereof or disappeared, had a tendency to be better in the resistance to breakage than that of Sample No. 42 not having such a region. However, it also was found that the Sample No. 42 showed a sufficiently improved balance between resistance to breakage and wear resistance, as compared with those in a conventional Sample No. 36.

incidentally, when each of the cemented carbides shown in Table 13 was used alone for a cutting tool without forming a coating layer to be disposed thereon, a loss of the tool was caused within one second counted from the start of machining under either set of the Cutting Conditions 3 and 4o As a result, the cemented carbide as such could not be used as a cutting tool at all.

EXAMPLE 6

Cemented carbide Sample Nos. 4', 15', 27', and 43' were prepared in the same manner as in the preparation of Cemented carbide Sample Nos. 4, 15, 27, and 43 of the cemented carbides used in Examples 1–5, except that the particle size of the coarse WC particles (the coarse particles B) was regulated in a range of from 3 to 6 μm. Then, the coating layer I was formed on the thus prepared cemented carbide thereby to provide coated cemented carbides (Table 15-1) described below.

Among the samples thus obtained, Sample Nos. 4'I, 15'I and 27'I were evaluated under the Cutting Conditions 1 and 2, and Sample No. 43'I was evaluated under the Cutting Conditions 3 and 4.

As a result, it was confirmed that the balance between wear resistance and breakage resistance was further improved as compared with that in a case using a particle size of from 3 to 10 μm. In other words, it was found more preferable that the particle size of the coarse WC particles was to be controlled in a range of from 3 to 6 μm.

TABLE 15-1

| Sample | Cutting Condition Cutting Life (Min.) | | | |
|---|---|---|---|---|
| No. | 1 | 2 | 3 | 4 |
| 4'I | 7.5 | 7.1 | | |
| 15'I | 8.0 | 10.0 | | |
| 27'I | 14.0 | 32.5 | | |
| 43'I | | | 19.2 | 50.8 |

EXAMPLE 7

Commercially available fine WC powder having an average particle size of 0.5 μm, Co powder, $Cr_3C_2$ powder, VC powder and coarse WC powder having an average particle size of 5 μm were provided. These starting material powders were subjected to wet mixing by using a ball mill for 24 hours, and then dried and press-molded under a pressure of 1.5 kg/cm$^2$. Then, the pressed powder product thus obtained was sintered in vacuum at 1450° C., and thereafter was subjected to an HIP treatment under a pressure of 1000 kg/cm$^2$.

While the ratio of the fine particles to the coarse particles to be used as WC powder was regulated, plural species of cemented carbides having different particle size distributions of WC crystals as a hard phase were prepared in accordance with the above process.

Table 16 as described below shows ratios of the fine particles A having a particle size of from 0.1 to 1.0 μm in WC crystals, the coarse particles B having a particle size of from 3.0 to 10 μm in WC crystals, ratios of Co, Cr and V with respect to the entire alloy, ratios (area ratios) $S_A/S_B$ of the fine WC particles A to the coarse WC particles B, carbon content (X) in the cemented carbides, lower limits of carbon content (a) for causing free carbon and upper limits of carbon content for causing an η phase for the respective cemented carbide compositions thus prepared. The particle size distribution of WC crystals in the cemented carbide was measured in the same manner as in Example 1 on the basis of observation of a mirror-polished texture of the cemented carbide with an optical microscope and a scanning electron microscope, as described hereinabove.

In the case of "Sample No. 55" according to the present invention, V was present in the cemented carbide partially in the form of a carbide thereof, and in Sample No. 58 according to the present invention, Cr was present in the cemented carbide partially in the form of a carbide thereof.

Each of the cemented carbides thus obtained was used as a substrate material, and a coating layer was formed on the surface of the substrate material by using an ordinary CVD or PVD process in the same manner as in Example 1 in accordance with Table 17 described below.

Each of the thus prepared coated cemented carbides (each in a combination of a substrate material and a coating layer as listed in Table 18 described below) was formed into a cutting tool having a shape of "Model SPGN 120308", and the performances thereof were evaluated under the following two kinds of Cutting Conditions by use of a workpiece of "Inconel 718". In each of the evaluation tests, the period until the time at which the flank wear reached 0.2 mm or the time at which a breakage occurred was measured as a cutting service life. All of the results thus obtained are inclusively listed in Table 18 described below.

As shown by the results described in the Table 18, it was found that each of the cutting tools comprising a coated cemented carbide sample according to the present invention, which comprised a cemented carbide substrate material comprising the fine WC particles and coarse WC particles, and a coating layer formed on a surface of the cemented carbide, was excellent both in the wear resistance and in the resistance to breakage, and was improved in the cutting performance.

Test conditions

Cutting speed: 60 m/min

Feed rate: 0.2 mm/rev

Depth of cut: 0.5 mm

Wet cutting

TABLE 16

| Sample No. | $S_A/S_B$ | (A+B)/WC | Co % wt % | Cr % wt % | V % wt % | $\frac{x-b}{a-b}$ |
|---|---|---|---|---|---|---|
| 46* | 0.14 | 95 | 6 | 0.5 | | 0.7 |
| 47* | 1.0 | 87 | 6.5 | | | 0.6 |
| 48* | 0.45 | 70 | 6.5 | | | 0.75 |
| 49* | 0.38 | 93 | 6 | 0.5 | | –0.60 |
| 50* | 0.38 | 93 | 6 | 0.5 | | 0.74 |

TABLE 16-continued

| Sample No. | $S_A/S_B$ | (A+B)/WC | Co wt % | Cr wt % | V wt % | $\frac{x-b}{a-b}$ |
|---|---|---|---|---|---|---|
| 51 | 0.38 | 93 | 6 | 0.5 | | 0.33 |
| 52 | 0.22 | 91 | 6.5 | | | −0.20 |
| 53 | 0.45 | 100 | 6.5 | | | 0.33 |
| 54 | 0.34 | 89 | 6 | 0.1 | | 0.50 |
| 55 | 0.34 | 80 | 6 | | 3 | 0.33 |
| 56 | 0.34 | 90 | 10 | 1.5 | 1.5 | 0.33 |
| 57 | 0.22 | 86 | 4 | | 0.1 | 0.33 |
| 58 | 0.22 | 80 | 7 | 3 | | 0.33 |

TABLE 17

| Coating Layer No. | 1st Layer (μm) | 2nd Layer (μm) | 3rd Layer (μm) |
|---|---|---|---|
| A* | None | — | — |
| B* | TiN (2.0) | TiCN (10.5) | — |
| C* | TiCN (0.1) | — | — |
| D | TiN (0.5) | TiCN (2.5) | — |
| E | TiN (0.5) | TiAlN (2.0) | — |
| F | TiN (2.0) | TiC (5.0) | TiN (1.5) |

TABLE 18

Cutting Life (Min.)

| | A* | B* | C* | D | E | F |
|---|---|---|---|---|---|---|
| 46* | 0.2 | 1.0 | 0.3 | 3.6 | 3.1 | 2.2 |
| 47* | 0.5 | 1.5 | 0.7 | 3.9 | 4.0 | 1.0 |
| 48* | 0.3 | 2.3 | 0.4 | 4.0 | 4.8 | 1.0 |
| 49* | 1.3 | 2.8 | 0.2 | 3.0 | 3.5 | 3.1 |
| 50* | 0.8 | 2.1 | 1.0 | 4.8 | 5.5 | 5.3 |
| 51 | 2.5 | 2.1 | 2.3 | 18.8 | 20.5 | 18.5 |
| 52 | 1.6 | 1.9 | 1.8 | 6.4 | 10.0 | 9.0 |
| 53 | 1.9 | 2.0 | 1.9 | 7.5 | 10.5 | 10.0 |
| 54 | Đ | Đ | Đ | 12.5 | 16.5 | 11.5 |
| 55 | Đ | Đ | Đ | 8.5 | 12.5 | 11.3 |
| 56 | Đ | Đ | Đ | 12.5 | 13.5 | 12.5 |
| 57 | Đ | Đ | Đ | 8.4 | 10.5 | 7.5 |
| 58 | Đ | Đ | Đ | 10.3 | 11.5 | 9.5 |

Samples surrounded by a box are those according to the present invention

EXAMPLE 8

Commercially available fine WC powder having an average particle size of 0.5 μm, Co powder, TiC powder, TaC powder, NbC powder, $Cr_3C_2$ powder, VC powder, and coarse WC powder having an average particle size of 5 μm were provided. These starting material powders were subjected to wet mixing by using a ball mill for 24 hours, and then dried and press-molded under a pressure of 1.5 kg/cm$^2$. Then, the pressed powder product thus obtained was sintered in vacuum at 1450° C., and thereafter was subjected to an HIP treatment under a pressure of 1000 kg/cm$^2$.

While the ratio of the fine particles to the coarse particles to be used as WC powder was regulated, plural species of cemented carbides having different particle size distributions of WC crystals as a hard phase were prepared in accordance with the above process.

Table 19 as described below shows ratios of the fine particles A having a particle size of from 0.1 to 1.0 μm in WC crystals, the coarse particles B having a particle size of from 3.0 to 10 μm in WC crystals, contents of Co, Cr and V with respect to the entire cemented carbide, amounts of composite carbides(amounts of TiC, TaC, NbC),ratios (area ratios) $S_A/S_B$ of the fine WC particles A to the coarse WC particles B, carbon content (X) in the cemented carbides, lower limits of carbon content (a) for causing free carbon and upper limits of carbon content (b) for causing an η phase for the respective cemented carbide compositions thus prepared.

The particle size distribution of WC crystals in the cemented carbide was measured in the same manner as in Example 1 on the basis of observation of a mirror-polished texture of the cemented carbide with an optical microscope and a scanning electron microscope, as described hereinabove.

In each of "Sample Nos. 59 to 65" containing two or more species of composite carbides, these carbides were present in the cemented carbide in the form of a mutual solid solution carbide. In each of the Samples, W was present somewhat in the form of a solid solution in the composite carbide.

In addition, in Sample Nos. 61 and 65, V was present in the cemented carbide partially in the form of a carbide thereof, and in Sample No. 60 according to the present invention, Cr was present partially in the form of a carbide thereof in the cemented carbide.

TABLE 19

| Sample N No. | $S_A/S_B$ | (A+B)/WC % | TiC wt % | TaC wt % | NbC wt % | Co wt % | Cr wt % | V wt % | $\frac{X-b}{a-b}$ |
|---|---|---|---|---|---|---|---|---|---|
| 59* | 0.38 | 89 | 2 | 2 | 2 | 10 | | | 0.5 |
| 60* | 0.34 | 88 | 9 | 2 | 1 | 10 | 3 | | 0.6 |
| 61* | 0.45 | 88 | 7 | 2 | | 8 | | 3 | 0.4 |
| 62 | 0.34 | 80 | 2 | 1.5 | 1.5 | 10 | 2.0 | 1.0 | 0.33 |
| 63 | 0.22 | 89 | 5 | | | 8 | | | 0.4 |
| 64 | 0.45 | 88 | | 5 | | 4 | 0.1 | | 0.5 |
| 65 | 0.34 | 90 | | | 5 | 8 | | 3 | 0.45 |

Each of the cemented carbides thus obtained was used as a substrate material, a coating layer (each of Coating Layers B, C and D to F in Table 17 in Example 7) was formed on the surface of the substrate material.

Each of the thus prepared coated cemented carbides (each in a combination of a substrate material and a coating layer as listed in Table 20 described below) was formed into a cutting tool having a shape of "Model SPGN 1200308", and the cutting performances thereof were evaluated in the same manner as in Example 7 thereby to determine the cutting service life thereof. All of the results thus obtained are inclusively listed in Table 20 described below.

As shown by the results described in the above Table 20, it was found that each of the cutting tools comprising a coated cemented carbide sample according to the present invention, which comprised a cemented carbide substrate material comprising the fine WC particles and coarse WC particles, and a coating layer formed on a surface of the substrate material was excellent both in the wear resistance and in the resistance to breakage, and was improved in the cutting performance.

TABLE 20

Cutting Life (Min.)

| | B* | C* | D | E | F |
|---|---|---|---|---|---|
| 59* | 3.0 | 2.0 | 2.8 | 3.0 | 4.5 |
| 60* | 3.5 | 3.0 | 3.3 | 3.8 | 4.8 |
| 61* | 4.0 | 3.8 | 4.0 | 4.2 | 5.0 |
| 62 | 4.2 | 4.0 | 7.0 | 5.5 | 6.0 |
| 63 | 4.5 | 4.2 | 10.0 | 9.0 | 7.0 |
| 64 | 4.0 | 3.6 | 16.0 | 13.0 | 18.0 |
| 65 | 3.8 | 3.5 | 13.5 | 14.2 | 12.0 |

Samples surrounded by a box are those according to the present invention

INDUSTRIAL APPLICABILITY

As described hereinabove, according to the present invention, there is provided a coated cemented carbide having both of strength and toughness in a well-balanced manner. The coated cemented carbide according to the present invention may suitably be used in the fields of mechanics such as general tools, and may particularly suitably be used for tools such as cutting tools, wear-resistant tools, impact-resistant tools, and mining tools (and further, for cutting tools for cutting general steel, hard-to-machine materials, etc).

When the coated cemented carbide according to the present invention is used as that for cutting tools, not only particularly superior resistance to initial breakage may be provided, but also the propagation of a fatigue crack may be suppressed particularly effectively.

We claim:

1. A coated cemented carbide, comprising:

a substrate comprising a WC-based cemented carbide containing 4 to 10 wt. % of Co as a binder phase; based on a ratio in a mirror-polished texture of a cross section of the cemented carbide, 70% or more of WC crystals as a hard phase being classified into either of a group of fine particles A having a particle size of from 0.1 to 1 μm and a group of coarse particles B having a particle size of from 3 to 10 μm, the area ratio ($S_A/S_B$) of the fine particles A to the coarse particles B being in a range of from 0.22 to 0.45; the WC-based cemented carbide having a particle size distribution having two peaks; and a coating layer disposed on a surface of the cemented carbide and having a total thickness in a range of from 5 to 100 μm; said coating layer comprising at least one layer comprising at least one selected from the group consisting of: carbides, nitrides, carbonitrides, oxycarbides, and boronitrides of Ti, Zr, and/or Hf; and at least one layer comprising at least one selected from the group consisting of: $Al_2O_3$ and oxides of Ti, Zr, or Hf.

2. A coated cemented carbide according to claim 1, wherein the cemented carbide substrate contains:

V;

Cr;

V and Cr;

at least one component selected from the group consisting of carbides, nitrides, or carbide/nitrides of V or Cr;

V and said at least one component;

Cr and said at least one component; or

V and Cr and said at least one component;

and the total amount of the component is in a range from 0.1 and 3 wt. %.

3. A coated cemented carbide according to claim 1, wherein the cemented carbide substrate contains:

at least one carbide of Ti, Nb, or Ta;

a solid solution of at least one carbide of Ti, Nb, or Ta; or said at least one carbide and said solid solution;

dispersed therein in an amount of 5 wt. % or less.

4. A coated cemented carbide according to claim 1, wherein the carbon content X (wt. %) in the cemented carbide substrate satisfies a relationship of:

$$-0.5 \leqq (X-b)/(a-b) \leqq 0.67,$$

wherein a (wt. %) denotes the lower limit of carbon content at which free carbon is formed in the cemented carbide, and b (wt. %) denotes the upper limit of carbon content at which an η phase is formed in the cemented carbide.

5. A coated cemented carbide according to claim 1, wherein the cemented carbide substrate contains at least one element of Ni and Fe in an amount of from 0.1 to 10 wt. %.

6. A coated cemented carbide according to claim 1, wherein the cemented carbide substrate contains at least one of a metal nitride and a metal carbonitride, the metal being selected from the group consisting of the Group IVa, Va, and VIa metal dispersed therein in an amount of from 0.1 to 15 wt. %.

7. A coated cemented carbide according to claim 6, wherein the cemented carbide substrate contains at least one of a metal nitride and a metal carbonitride, the metal being selected from the group consisting of Zr, Ta, and Nb dispersed therein in an amount of from 0.1 to 15 wt. %.

8. A coated cemented carbide according to claim 1, wherein the cemented carbide substrate has a 5 to 50 μm-thick surface region such that it contains substantially none or a smaller amount of a metal carbide, a metal nitride, or a metal carbonitride, the metal being selected from the group consisting of the Group IVa, Va, and VIA metal except for WC;

a solid solution of said metal carbide, a metal nitride, or a metal carbonitride; or said metal carbide, a metal nitride, or a metal carbonitride, and said solid solution thereof, as compared with that in the interior of the cemented carbide.

9. A coated cemented carbide, comprising: a substrate comprising a WC-based cemented carbide containing 4 to 10 wt. % of Co as a binder phase and a particle size distribution having two peaks; and a coating layer disposed on a surface of the cemented carbide and having a total thickness in a range of from 0.2 to 10 μm;

(a) based on a ratio in a mirror-polished texture of a cross section of the cemented carbide substrate, 70% or more of WC crystals as a hard phase being classified into either of a group of fine particles A having a particle size of from 0.1 to I μm and a group of coarse particles B having a particle size of from 3 to 10 μm, the area ratio $S_A/S_B$ of the fine particles A to the coarse particles B being in a range of from 0.22 to 0.45;

(b) the carbon content X (wt. %) in the cemented carbide substrate satisfies a relationship of:

$$-0.5 \leqq (X-b)/(a-b) \leqq 0.67t$$

wherein a (wt. %) denotes the lower limit of carbon content at which free carbon is formed in the cemented carbide having the corresponding composition, and b (wt. %) denotes the upper limit of carbon content at which an η phase is formed in the cemented carbide having the corresponding composition; and (c) the coating layer comprising at least one layer comprising a carbide, nitride, or carbonitride of Ti, or a carbide, nitride, or carbonitride of an alloy of Ti and Al.

10. A coated cemented carbide according to claim 9, wherein the cemented carbide substrate contains:

V;

Cr;

V and Cr;

at least one component selected from the group consisting of carbides, nitrides, or carbide/nitrides of V or Cr;

V and said at least one component;

Cr and said at least one component; or

V and Cr and said at least one component;

and the total amount of the component is in a range of from 0.1 to 3 wt. %.

11. A coated cemented carbide according to claim 9, wherein the cemented carbide substrate contains:

at least one carbide of Ti, Nb, or Ta, a solid solution of at least one carbide of Ti, Nb or Ta;

said at least one carbide and said solid solution;

dispersed therein in an amount of 5 wt. % or less.

12. A coated cemented carbide according to claim 6, wherein the Group IVa, Va and VIa metal is selected from the group consisting of Ti, Hf, Zr, Ta and Nb.

13. A coated cemented carbide according to claim 8, wherein the Group IVa, Va and VIa metal is selected from the group consisting of Ti, Hf, Zr, Ta and Nb.

* * * * *